US007735987B2

(12) United States Patent
Umeda

(10) Patent No.: US 7,735,987 B2
(45) Date of Patent: Jun. 15, 2010

(54) LIQUID-DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 213 days.

(21) Appl. No.: 12/128,140

(22) Filed: May 28, 2008

(65) Prior Publication Data

US 2008/0297578 A1 Dec. 4, 2008

(30) Foreign Application Priority Data

May 31, 2007 (JP) ..... 2007-145544

(51) Int. Cl.
*B41J 2/19* (2006.01)
*B41J 29/38* (2006.01)

(52) U.S. Cl. ..... 347/92; 347/17; 347/93

(58) Field of Classification Search ..... None
See application file for complete search history.

(56) References Cited

U.S. PATENT DOCUMENTS

| | | | | |
|---|---|---|---|---|
| 5,546,109 | A * | 8/1996 | Nakano | 347/93 |
| 2001/0019347 | A1* | 9/2001 | Hauck | 347/86 |
| 2006/0139419 | A1 | 6/2006 | Shigemura | |
| 2006/0203047 | A1 | 9/2006 | Koga et al. | |
| 2007/0046747 | A1* | 3/2007 | Takemoto | 347/92 |

FOREIGN PATENT DOCUMENTS

| | | |
|---|---|---|
| JP | 2004009450 | 1/2004 |
| JP | 2006247936 | 9/2006 |

OTHER PUBLICATIONS

European Search Report Mailed Sep. 30, 2008, in European Patent Application No. 08009859.3.

* cited by examiner

*Primary Examiner*—Omar Rojas
(74) *Attorney, Agent, or Firm*—Baker Botts, LLP.

(57) ABSTRACT

A liquid-droplet ejecting apparatus including a liquid ejecting head having an ejection opening from which a droplet of a liquid is ejected, a first tank in which a liquid storing chamber storing the liquid to be supplied to the liquid ejecting head and a gas chamber storing a gas are formed, a second tank storing the liquid to be supplied to the liquid storing chamber, a gas-permeable film which closes a communication portion at which the gas chamber and liquid storing chamber communicate with each other, separates the gas chamber and liquid storing chamber from each other, and allows the gas to pass therethrough but does not allow the liquid to pass therethrough, a suction passage in communication with the gas chamber, a sucking device sucking the gas from the gas chamber through the suction passage, and a pressure control device disposed in the suction passage and communicating an internal space of the suction passage with an external space of the suction passage when an internal pressure of the suction passage decreases below a threshold lower than the atmospheric pressure due to the sucking of the gas by the sucking device, in order to inhibit the internal pressure of the suction passage from excessively decreasing.

14 Claims, 13 Drawing Sheets

LIQUID-DROPLET EJECTING APPARATUS

CROSS REFERENCE TO RELATED APPLICATION

The present application claims priority from Japanese Patent Application No. 2007-145544 filed on May 31, 2007 the disclosure of which is herein incorporated by reference in their entirety.

BACKGROUND OF THE INVENTION

1. Field of the Invention

The present invention relates to a liquid-droplet ejecting apparatus, and particularly to a liquid-droplet ejecting apparatus in which a gas-permeable film is disposed in a tank from which a liquid is supplied.

2. Description of Related Art

Some of the liquid-droplet ejecting apparatuses including a liquid ejecting head for ejecting droplets of a liquid, such as inkjet printer, further include a tank from which the liquid is supplied to the liquid ejecting head, as disclosed in JP-A-2004-9450. The apparatus disclosed in this publication includes a carriage, a recording head mounted on the carriage, a sub tank, an ink cartridge, and a suction pump. The ink cartridge stores an ink to be supplied to the recording head via the sub tank and an ink supply passage.

The sub tank in this apparatus has a gas-permeable film or member in the form of an air-permeable film. The gas-permeable film does not allow the ink to pass therethrough, but selectively allows gas or air to pass therethrough. A gas or air in the sub tank is removed from an inside of the sub tank, for instance by sucking the gas or air therefrom through the gas-permeable film. Thus, the gas or air contained in the ink stored in the sub tank is separated from the ink, or "gas-liquid separation" is implemented on the ink in the sub tank, so as to inhibit inflow of the gas or air into the liquid ejecting head.

When the gas or air is sucked from the inside of the sub tank through the gas-permeable film, the gas-permeable film may be damaged or come off.

SUMMARY OF THE INVENTION

This invention has been developed in view of the above-described situations, and it is an object of the invention, therefore, to provide a liquid-droplet ejecting apparatus including a gas-permeable film in which it is prevented that an excessive force is imposed on the gas-permeable film when a gas or air is sucked through the gas-permeable film.

To attain the above object, the invention provides a liquid-droplet ejecting apparatus in the following modes.

(1) A liquid-droplet ejecting apparatus including:

a liquid ejecting head having an ejection opening from which a droplet of a liquid is ejected;

a first tank in which a liquid storing chamber and a gas chamber are formed, the liquid storing chamber storing the liquid to be supplied to the liquid ejecting head, and the gas chamber storing a gas;

a second tank which stores the liquid to be supplied to the liquid storing chamber of the first tank;

a gas-permeable film which closes a communication portion at which the gas chamber and the liquid storing chamber communicate with each other and separates the gas chamber and the liquid storing chamber from each other, the gas-permeable film allowing the gas to pass therethrough but not allowing the liquid to pass therethrough;

a suction passage in communication with the gas chamber;

a sucking device which sucks the gas from the gas chamber through the suction passage; and a pressure control device disposed in the suction passage, the pressure control device communicating an internal space of the suction passage with an external space of the suction passage when an internal pressure of the suction passage decreases below a threshold lower than the atmospheric pressure due to the sucking of the gas by the sucking device, in order to inhibit the internal pressure of the suction passage from excessively decreasing.

According to this liquid-droplet ejecting apparatus, when the internal pressure of the suction passage decreases to the threshold, the pressure control device communicates the suction passage with the external space of the suction passage in order to take the gas outside the suction passage into the suction passage, whereby an excessive decrease in an internal pressure of the gas chamber is inhibited. Thus, it is prevented that the gas-permeable film comes off or is damaged due to an excessive force imposed on the gas-permeable film.

(2) The liquid-droplet ejecting apparatus according to the mode (1), wherein the pressure control device includes:

a pressure control chamber having:

a first port in communication with the gas chamber via a part of the suction passage on the side of the gas chamber;

a second port in communication with the sucking device via another part of the suction passage on the side of the sucking device; and a third port in communication with the external space of the suction passage;

a valve element which is disposed in the pressure control chamber and movable between a closing position to close the third port and an opening position to open the third port; and an elastic member which biases the valve element with a biasing force in a direction to move the valve element from the opening position toward the closing position, the biasing force being set such that when an internal pressure of the pressure control chamber is equal to or higher than the threshold, the valve element is held at the closing position, and when the internal pressure of the pressure control chamber is below the threshold, the valve element is allowed to move from the closing position to the opening position due to a pressure difference between the opposite sides of the valve element.

According to the liquid-droplet ejecting apparatus of the mode (2), when the internal pressure of the pressure control chamber is equal to or higher than the threshold, the valve element closes the third port to disconnect the gas chamber from the external space of the suction passage while the sucking device can suck the gas from the gas chamber via the first and second ports. On the other hand, when the internal pressure of the pressure control chamber decreases below the threshold, the valve element moves to open the third port to communicate the gas chamber with the external space of the suction passage. In this way, the pressure control device is simple in structure.

(3) The liquid-droplet ejecting apparatus according to the mode (2), further including:

a mist catching device having a mist suction opening at which is caught a mist of the liquid that occurs in a space outside and around the liquid ejecting head due to the ejection of the droplet of the liquid from the ejection opening; and a gas passage having two opposite ends, one of which is in communication with the third port, and the other of which is in communication with the space outside and around the liquid ejecting head via the mist catching device.

According to the liquid-droplet ejecting apparatus of the mode (3) in which the third port and the mist suction opening of the mist catching device are in communication with each other through the gas passage, the gas is sucked through the mist suction opening of the mist catching device in order that a mist of the liquid along with the gas is sucked from the mist suction opening, while the valve element is at its opening position. Hence, the mist catching device can catch the mist of the liquid even without an additional sucking device disposed for the mist catching device.

(4) The liquid-droplet ejecting apparatus according to the mode (2), wherein the liquid ejecting head further has:

an ejection passage in communication with the ejection opening; and an ejection-energy giving device which gives ejection energy to the liquid in the ejection passage in order to eject the droplet of the liquid from the ejection opening, and wherein the liquid-droplet ejecting apparatus further comprises:

a driver circuit for supplying the ejection-energy giving device with a drive signal for driving the ejection-energy giving device;

a heatsink which receives heat generated by the driver circuit; and a gas passage having two opposite ends, a first one of which is in communication with the third port, and a second one of which is in communication with an external space of the liquid ejecting head and fixed on the heatsink.

According to the liquid-droplet ejecting apparatus of the mode (4) in which the second end of the gas passage is fixed on the heatsink, a gas flow occurs in a vicinity of the heatsink when the gas in the vicinity of the heatsink is taken into the gas passage while the valve element is at its opening position. Hence, heat can be removed or discharged from the heatsink through the gas passage, even without an additional sucking device disposed for sucking the gas from the vicinity of the heatsink.

(5) The liquid-droplet ejecting apparatus according to the mode (4), wherein the heatsink has a void formed inside the heatsink, and at least two connecting ports in communication with the void, the second end of the gas passage being connected with one of the at least two connecting ports.

(6) The liquid-droplet ejecting apparatus according to the mode (2), wherein the liquid ejecting head further has:

an ejection-energy giving device which gives ejection energy to the liquid in the ejection passage in order to eject the droplet of the liquid from the ejection opening;

a driver circuit for supplying the ejection-energy giving device with a drive signal for driving the ejection-energy giving device;

a heatsink which receives heat generated by the driver circuit, and has a void formed inside the heatsink and at least two connecting ports in communication with the void;

a mist catching device having a mist suction opening at which is caught a mist of the liquid that occurs in a space outside and around the liquid ejecting head due to the ejection of the droplet of the liquid from the ejection opening;

a first gas passage which communicates one of the at least two connecting ports of the heatsink with the third port of the pressure control chamber; and a second gas passage which communicates another one of the at least two connecting ports with the mist catching device, and is in communication with the space outside and around the liquid ejecting head through the mist suction opening of the mist catching device.

(7) The liquid-droplet ejecting apparatus according to the mode (5) or (6), wherein both the heatsink and the void inside the heatsink extend along the driver circuit.

(8) The liquid-droplet ejecting apparatus according to the mode (3) or (6), wherein the mist catching device includes a filter covering the mist suction opening.

(9) A liquid-droplet ejecting apparatus comprising:

a liquid ejecting head having an ejection opening from which a droplet of a liquid is ejected;

a first tank in which a liquid storing chamber and a gas chamber are formed, the liquid storing chamber storing the liquid to be supplied to the liquid ejecting head, and the gas chamber storing a gas;

a second tank which stores the liquid to be supplied to the liquid storing chamber of the first tank;

a gas-permeable film which closes a communication portion at which the gas chamber and the liquid storing chamber communicate with each other and separates the gas chamber and the liquid storing chamber from each other, the gas-permeable film allowing the gas to pass therethrough but not allowing the liquid to pass therethrough;

a suction passage in communication with the gas chamber; and a sucking device which sucks the gas from the gas chamber through the suction passage.

According to the liquid-droplet ejecting apparatus of the mode (9) including the gas-permeable film, it is enabled to discharge the gas from the gas chamber while it is prevented that the liquid is sucked through the gas chamber.

(10) The liquid-droplet ejecting apparatus according to the mode (1) or (9), further including:

a mist catching device having a mist suction opening at which is caught a mist of the liquid that occurs in a space outside and around the liquid ejecting head due to the ejection of the droplet of the liquid from the ejection opening; and a gas passage having two opposite ends, one of which is in communication with the sucking device, and the other of which is in communication with the space outside and around the liquid ejecting head via the mist catching device.

The mist catching device may be connected with the sucking device via the suction passage, or not via the suction passage, but it should be ensured in either case that the sucking of the gas from the gas chamber of the first tank is not hampered. For instance, the mist catching device is connected with the third port of the pressure control chamber. However, as long as the sucking of the gas from the gas chamber of the first tank is not hampered, other arrangements, e.g., an arrangement where a control valve that is switchable between a state to communicate the sucking device with the gas chamber and a state to communicate the sucking device with the mist catching device is used, may be employed. The feature of any one of the modes (2), (3) and (8) is applicable to the liquid-droplet ejecting apparatus of the mode (10).

(11) The liquid-droplet ejecting apparatus according to any one of the modes (1), (9) and (10), wherein the liquid ejecting head further has an ejection passage in communication with the ejection opening and an ejection-energy giving device which gives ejection energy to the liquid in the ejection passage in order to eject the droplet of the liquid from the ejection opening, and wherein the liquid-droplet ejecting apparatus further comprises:

a driver circuit for supplying the ejection-energy giving device with a drive signal for driving the ejection-energy giving device;

a heatsink which receives heat generated by the driver circuit, and has a void formed inside the heatsink and at least two connecting ports in communication with the void; and a gas passage having two opposite ends one of which is connected with one of the at least two connecting ports of the heatsink, and the other of which is connected with the sucking device.

According to the liquid-droplet ejecting apparatus of the mode (11), the sucking device for sucking the gas through the gas-permeable film is utilized to cool the heatsink.

The heatsink may be connected with the sucking device via the suction passage, or not via the suction passage, but it should be ensured in either case that the sucking of the gas from the gas chamber of the first tank is not hampered. For instance, the mist catching device is connected with the third port of the pressure control chamber. However, as long as the sucking of the gas from the gas chamber of the first tank is not hampered, other arrangements, e.g., an arrangement where a control valve that is switchable between a state to communicate the sucking device with the gas chamber and a state to communicate the sucking device with the heatsink is used, may be employed. The feature of any one of the modes (2), (3), (5) and (7) is applicable to the liquid-droplet ejecting apparatus of the mode (11).

(12) The liquid-droplet ejecting apparatus according to any one of the modes (1)-(11), further including a recording controller which implements a recording operation in which the droplet of the liquid is ejected from the ejection opening.

(13) The liquid-droplet ejecting apparatus according to the mode (12), wherein the liquid ejecting head has a plurality of the ejection openings which are arranged in a straight line.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

Figure 1:
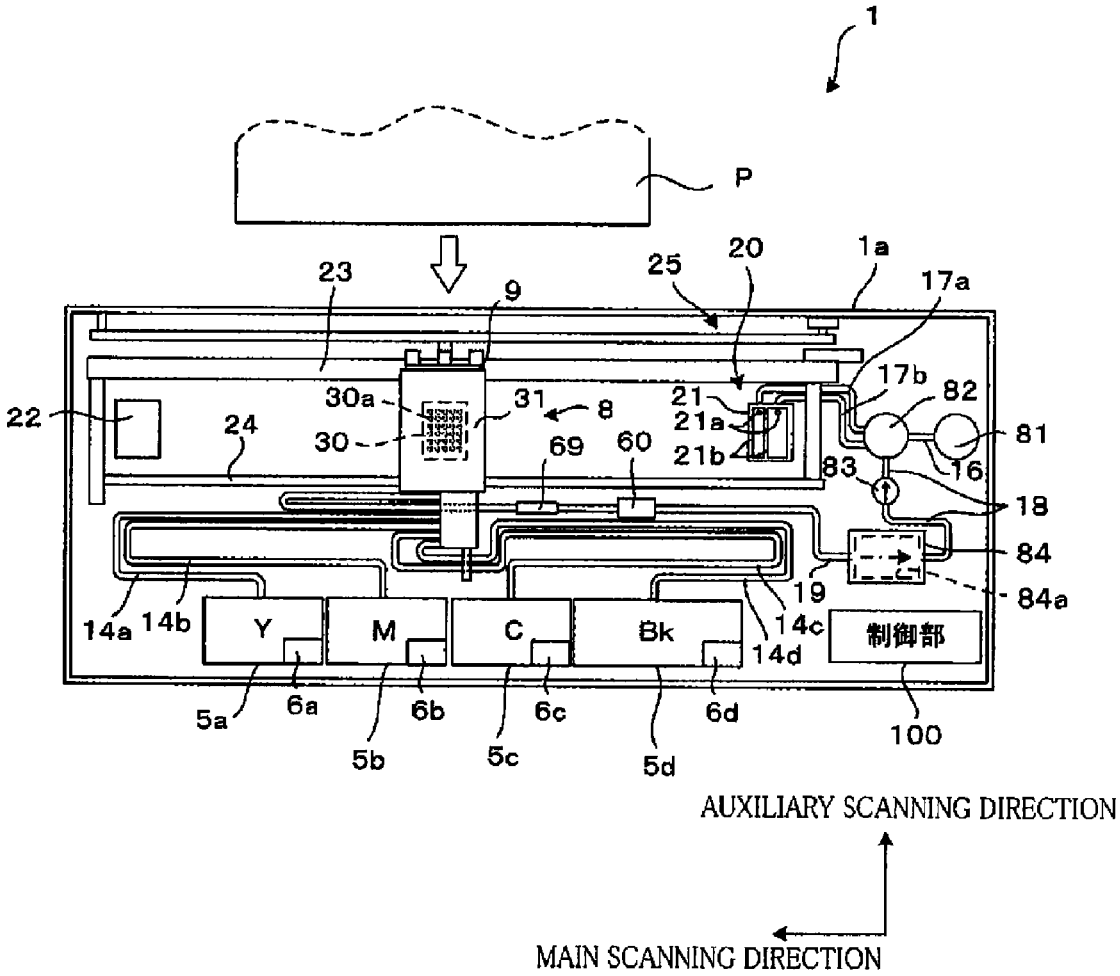
FIG. 1 is a plan view of an inkjet printer according to a first embodiment of the invention.

With reference to FIGS. 1-11, there will be described an inkjet printer according to a first embodiment of the invention. FIG. 1 is a schematic plan view of the inkjet printer denoted by reference numeral 1. In the following description, a main scanning direction and an auxiliary scanning direction are a lateral direction and a vertical direction as seen in FIG. 1, respectively.

The inkjet printer 1 includes an inkjet head 8 as a form of a liquid ejecting head of the invention. The inkjet head 8 ejects droplets of ink as a form of a liquid of the invention. The inkjet head 8 has a carriage 9 and a head mainbody 30 fixed on the carriage 9. At a lower or under surface of the head mainbody 30 are formed a plurality of nozzles 30*a* (as ejection openings), from which ink droplets are ejected. The head mainbody 30 is fixed on the carriage 9 with the nozzles 30*a* exposed or open downward. On an upper surface of the head mainbody 30, a sub tank 31 (as a first tank) is fixed. The sub tank 31 will be described later.

In the inkjet printer 1, guide frames 23 and 24 are disposed side by side with a spacing therebetween in the auxiliary scanning direction and extend parallel to the main scanning direction. The carriage 9 is disposed across the guide frames 23, 24 to be reciprocable on the guide frames 23, 24 along the main scanning direction. The inkjet printer 1 further includes a main frame 1*a*, in which a carriage moving device 25 is disposed. The carriage moving device 25 has a drive motor for reciprocating the carriage 9 in the main scanning direction.

The inkjet printer 1 further includes main tanks 5*a*-5*d* (as second tanks) from which ink is supplied to the head mainbody 30. More specifically, the main tanks 5*a*-5*d* store inks of respective colors, namely, yellow (Y), magenta (M), cyan (C), and black (Bk).

In the main tanks 5*a*-5*d*, remaining-amount detecting devices 6*a*-6*d* are respectively disposed for detecting amounts of the inks remaining in the main tanks 5*a*-5*d*. Each remaining-amount detecting device 6*a*-6*d* detects the amount of the remaining ink in the corresponding main tank 5*a*-5*d*, and sends a control unit 100 (described later) a result of the detection that indicates whether the amount of the remaining ink in the main tank 5*a*-5*d* is nearly zero. That is, when the amount of the remaining ink is equal to the threshold, the corresponding tank is not completely empty or depleted and contains an amount of the ink that enables some image recording. For instance, the remaining-amount detecting device 6*a*-6*d* is constituted by a float and a shield plate that are disposed in the tank 5*a*-5*d*, and an optical sensor. The shield plate vertically moves with the float, in accordance with a shift of a level of the ink surface. As the ink surface lowers, the shield plate passes the detection position, which is detected by the optical sensor. Upon detecting the passing of the detection position by the shield plate, the optical sensor outputs a signal representative thereof to the control unit 100.

The inks stored in the main tanks 5*a*-5*d* are first supplied to the sub tank 31 via respective ink tubes 14*a*-14*d* and stored there, and thereafter supplied to the head mainbody 30. The inks supplied to the head mainbody 30 are downward ejected from the nozzles 30*a*. The inkjet printer 1 further includes a medium feed device (not shown). The medium feed device operates to feed a recording medium P to a recording position under the guide frames 23 and 24. Onto the recording medium P thus located at the recording position, droplets of the inks are ejected from the head mainbody 30.

The inkjet printer 1 further includes the control unit 100 for controlling various kinds of operations of the inkjet printer 1. That is, in the inkjet printer 1 is installed hardware such as a processor circuit and various kinds of storage devices for storing various kinds of software including programs for operating the processor circuit, and a combination of the hardware and the software constitutes the control unit 100. The control unit 100 implements a recording operation for forming on a recording medium an image, which includes character, symbol, and graphic, by controlling feeding of a recording medium by the medium feed device, movement of the carriage 9 by the carriage moving device 25, and ejection of ink droplets from the head mainbody 30, on the basis of image data. It may be arranged such that when the result of the detection outputted from any of the remaining-amount detecting devices 6*a*-6*d* indicates that the amount of the ink remaining in the main tank 5*a*-5*d* in which the remaining-amount detecting device 6*a*-6*d* is disposed is nearly zero, the control unit 100 presents a message indicating this fact on a display device (not shown). At the moment the result outputted from the remaining-amount detecting device 6*a*-6*d* first indicates that the amount of the ink remaining in the main tank 5*a*-5*d* being nearly zero, the control unit 100 starts counting the number of times the inkjet head 8 ejects a droplet of the ink stored in the main tank 5*a*-5*d* in question. This number of times of ejection is used in a remaining-amount determination processing which will be described later.

Between the guide frames 23 and 24, an absorbing member 22 is disposed. The absorbing member 22 is located at a position near one of two opposite ends (i.e., a left end as seen in FIG. 1) of the guide frames 23 and 24 with respect to the main scanning direction. By moving the carriage 9 in the main scanning direction, the head mainbody 30 can be located just over the absorbing member 22. The absorbing member 22 is formed of a porous material such as urethane foam, and capable of absorbing the inks ejected from the head mainbody 30. The control unit 100 has the carriage 9 move to the position just over the absorbing member 22, and has the head mainbody 30 eject ink droplets that are absorbed by the absorbing member 22. In this way, a flushing processing for flushing the nozzles 30*a* is implemented.

In the inkjet printer 1, a capping device 20 is disposed for maintenance of an area in the lower surface of the inkjet head 8 across which the nozzles 30*a* are arranged. The capping device 20 has a suction cap 21 disposed to be located just under the head mainbody 30 when the carriage 9 is moved to a predetermined maintenance position, which is disposed at a position near right ends of the guide frames 23 and 24 as seen in FIG. 1.

Two upward protrusions 21*b* are formed on an upper surface of the suction cap 21. Each of the upward protrusions 21*b* takes the form of a wall surrounding a rectangular region in plan view. While the carriage 9 is at the maintenance position, the upward protrusions 21*b* surround respective groups of nozzles 30*a* each arranged on the lower surface of the head mainbody 30 in plan view.

The suction cap 21 is disposed in the inkjet printer 1 such that while the carriage 9 is at the maintenance position, the suction cap 21 can be vertically moved. More specifically, the suction cap 21 is movable between a covering position to have the upward protrusions 21*b* in close contact with the lower surface of the head mainbody 30 so as to cover the nozzles 30*a*, and an uncovering position to have the upward protrusions 21*b* downward retract or separate from the lower surface of the head mainbody 30 to uncover the nozzles 30*a*. The capping device 20 has a moving mechanism (not shown) for moving the suction cap 21 between the covering and uncovering positions. Two suction openings 21*a* are formed in the upper surface of the suction cap 21 in respective areas that are surrounded by the upward protrusions 21*b* in plan view.

The inkjet printer 1 further includes a suction pump 81, which is a form of a sucking device of the invention, and a flow-path switching device 82. The suction pump 81 and the flow-path switching device 82 are connected with each other via an air tube 16. The flow-path switching device 82 has first to fourth ports. The first port is connected with one end of the air tube 16, the second port is connected with one end of an air tube 17*a*, the third port is connected with one end of an air tube 17*b*, and the fourth port is connected with one end of an air tube 18. The other ends of the air tubes 17*a* and 17*b* are respectively connected with the suction openings 21*a* of the suction cap 21. The flow-path switching device 82 can selectively communicate the first port with one of the second to fourth ports. Thus, for instance, by communicating the first port with the second port, a state where the suction pump 81 can suck the air from one of the suction openings 21*a* via the air tubes 16 and 17*a* is established, and by communicating the first port with the third port, a state where the suction pump 81 can suck from the other suction opening 21*a* via the air tubes 16 and 17*b* is established.

The other end of the air tube 18 is connected with a charge tank 84. When the suction pump 81 operates to suck the air, the charge tank 84 along with an air chamber 51 (described later) operates to accumulate pressure. In the charge tank 84 is defined an internal space 84*a*, one of two opposite ends of which is in communication with the air tube 18. The other end of the internal space 84*a* is in communication with one end of an air tube 19. A cross-sectional area of the internal space 84*a*, which is perpendicular to a direction of air flow in the internal space 84*a* as indicated by one-dot chain line in FIG. 1, i.e., from one of the two ends of the internal space 84*a* to the other end, is larger than cross-sectional areas of the air tubes 18 and 19, which areas are perpendicular to directions of extension of the air tubes 18, 19. On the other hand, the other end of the air tube 19 is connected with the sub tank 31.

Figure 2:
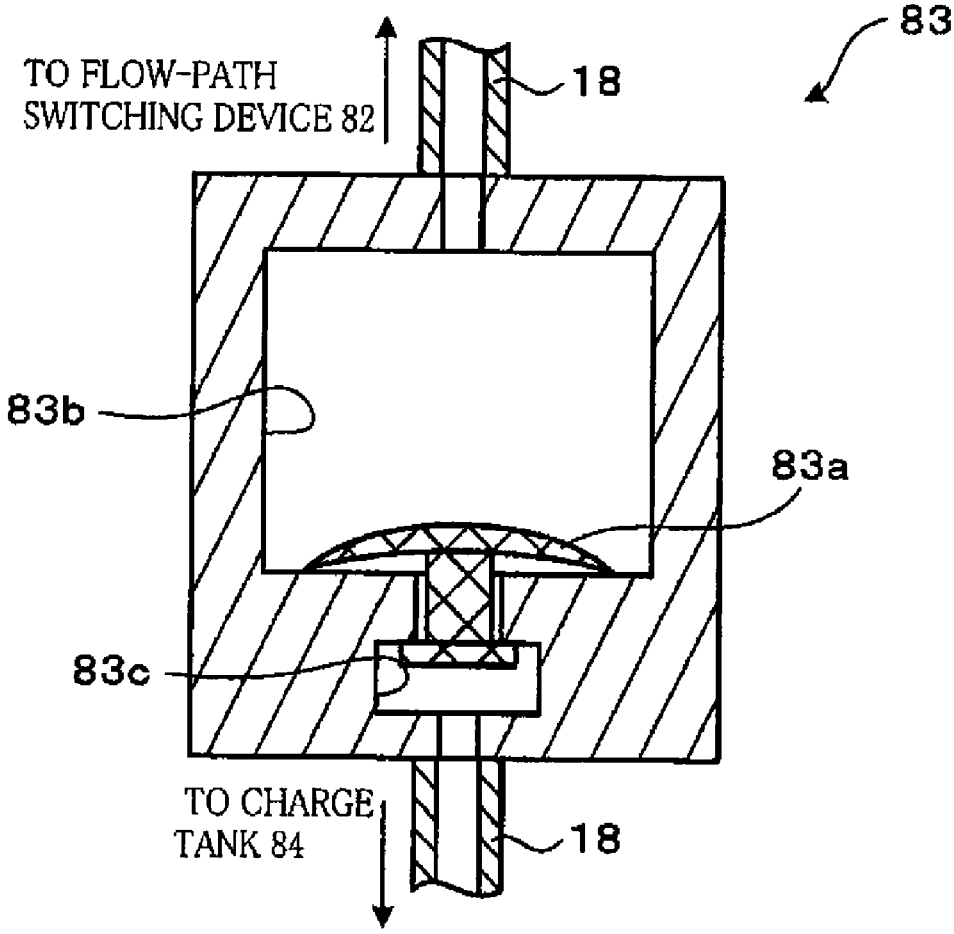
FIG. 2 is a cross-sectional view of a check valve of the inkjet printer.

At a point in the air tube 18, a check valve 83 is disposed. FIG. 2 shows one example of the check valve 83, in which are formed a first valve chamber 83*b* and a second valve chamber 83*c* that are in communication with the air tube 18, on the side of the flow-path switching device 82 and on the side of the charge tank 84, respectively. In the first and second valve chambers 83*b* and 83*c*, a valve element 83*a* is accommodated. The valve element 83*a* has a bevel portion, which deforms in accordance with a pressure difference between an internal pressure of the first valve chamber 83*b* and that of the second valve chamber 83*c*. When the internal pressure of the valve chamber 83*c* is below a first threshold lower than the atmospheric pressure, the valve element 83*a* is at a closing position to close a communication portion at which the first and second valve chambers 83*b* and 83*c* can communicate with each other, and when the internal pressure of the valve chamber 83*c* is equal to or higher than the first threshold, the valve element 83*a* is movable between the closing position and an opening position to open the communication portion between the first and second valve chambers 83*b*, 83*c*.

When the air in the first valve chamber 83*b* is sucked from the side of the flow-path switching device 82 via the air tube 18 while the valve element 83*a* is movable between the closing and opening positions, the valve element 83*a* is held at the opening position and the air is sucked from a part of the air tube 18 on the side of the charge tank 84 via the second valve chamber 83*c*. On the other hand, while the valve element 83*a* is at the closing position, the second valve chamber 83*c* is disconnected from the first valve chamber 83*b*, the air does not flow into the second valve chamber 83*c* from the first valve chamber 83*b*. In this way, the check valve 83 controls air flow in the air tube 18 such that the air flows only in a direction from the charge tank 84 to the flow-path switching device 82.

In the air tube 19, there are disposed at respective points a pressure detecting device 60 and a pressure limiter 69 (both described later). The pressure detecting device 60 can detect a level of an internal pressure of the air tube 19, and the pressure limiter 69 operates when the internal pressure of the air tube 19 extremely decreases.

As described above, the sub tank 31 and the flow-path switching device 82 are communicated with each other via the air tube 19, the charge tank 84, and the air tube 18. By having the flow-path switching device 82 communicate the first port with the fourth port, a state where the suction pump 81 can suck the air from the sub tank 31 via the air tubes 16, 18, the charge tank 84, and the air tube 19 is established.

Figure 3:
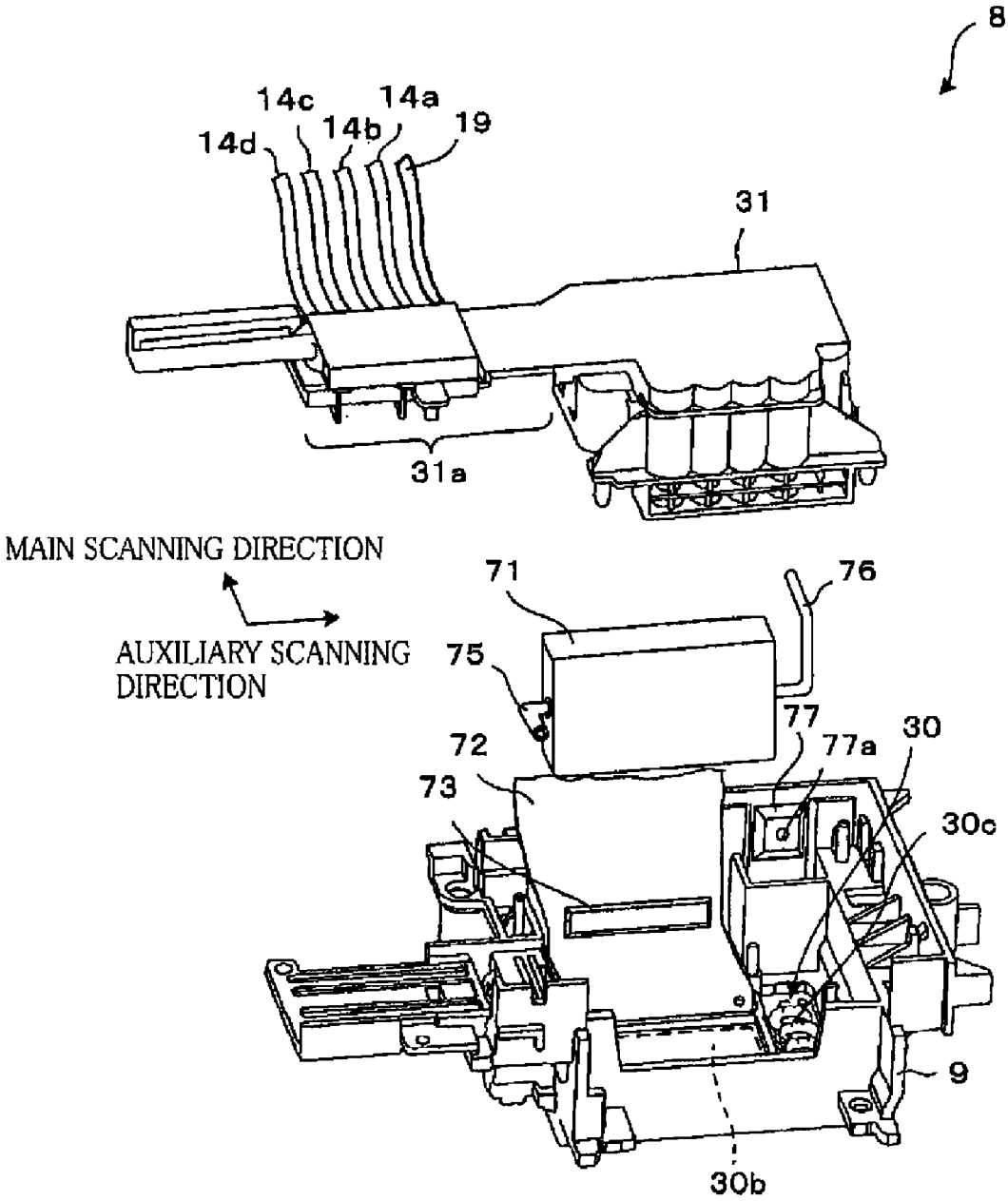
FIG. 3 is a perspective view showing an inkjet head shown in FIG. 1, in a state where a sub tank and others are removed from a carriage.
Figure 4:
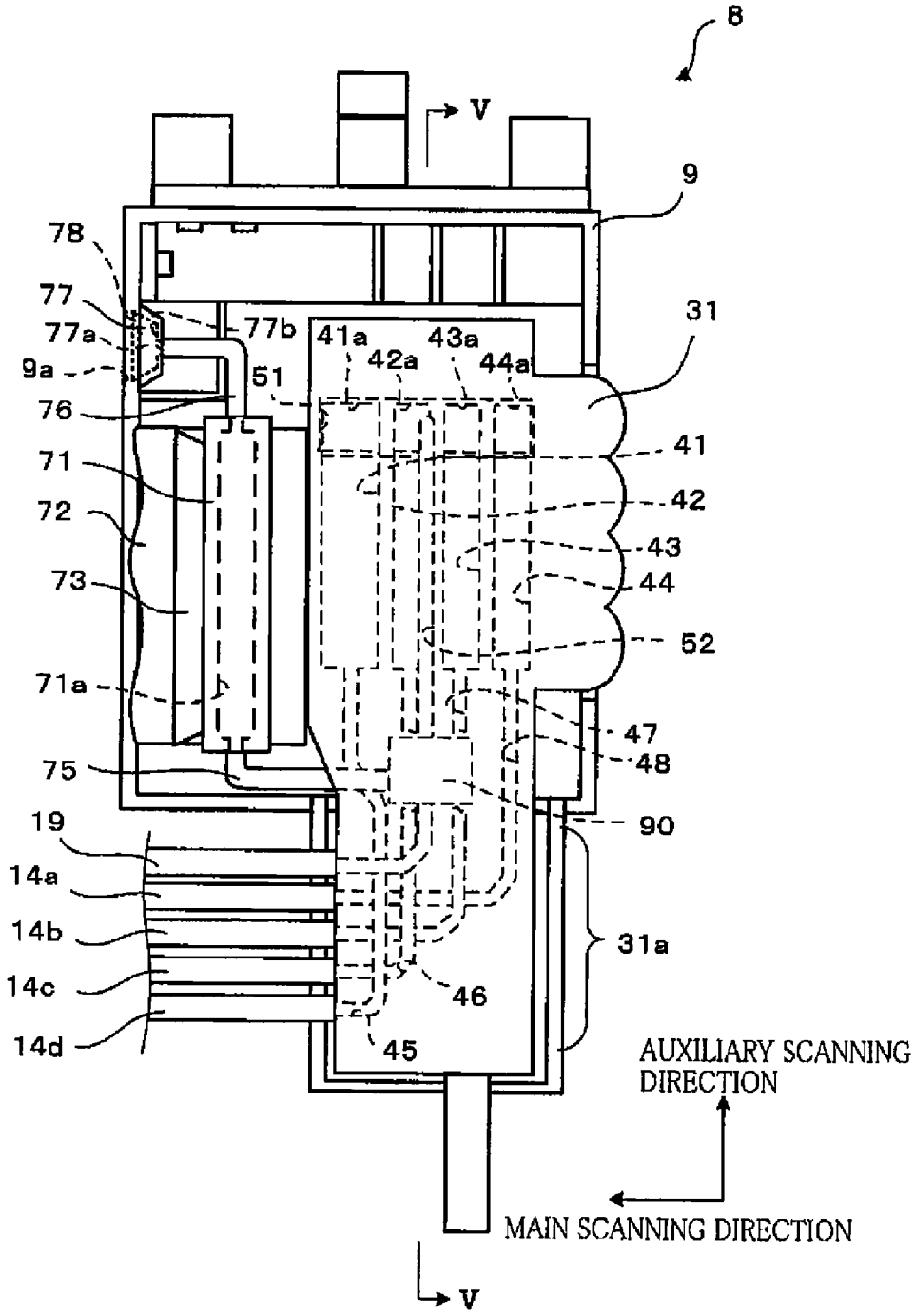
FIG. 4 is a plan view of the inkjet head where a head cover is removed.

Referring to FIGS. 3 and 4, the inkjet head 8 will be described in further detail. FIG. 3 is a perspective view of the inkjet head 8 where a head cover, the sub tank 31, and others are removed from the carriage 9. FIG. 4 is a plan view of the inkjet head 8 in a state where the head cover is removed. The carriage 9 generally has the shape of a rectangular parallelepiped or a box open on the upper side. The carriage 9 accommodates the sub tank 31 and the head mainbody 30, and the head cover (not shown in FIGS. 3 and 4) covers the carriage 9 from the upper side.

The sub tank 31 has an introducing portion 31*a* which the ink tubes 14*a*-14*d* and the air tube 19 are connected with. The head mainbody 30 is fixed on a bottom of the carriage 9. As shown in FIG. 3, on an upper surface of the head mainbody 30, four ports 30*c* are formed. The ports 30*c* function as inlets through which the four inks of different colors are respectively introduced. The sub tank 31, which has ink outlets for supplying the inks to the head mainbody 30 therethrough, is accommodated in the carriage 9 and above the head mainbody 30, such that the ink outlets are in communication with the ports 30*c*.

In the head mainbody 30, ink passages (not shown) are formed. One of two opposite ends of each ink passage communicates with one of the nozzles 30*a*, and the other end thereof communicates with one of the ports 30*c*. To the upper surface of the head mainbody 30, an ejection actuator 30*b* is attached, as shown in FIG. 3. The ejection actuator 30*b* selectively gives the inks, which fill the ink passages in the head mainbody 30, ejection energy so as to eject droplets of the inks from the nozzles 30*a* open in the lower surface of the head mainbody 30. For instance, the ejection actuator 30*b* is constituted by a piezoelectric layer and an electrode layer for generating an electric field at the piezoelectric layer in order to deform the piezoelectric layer. When a drive signal is supplied to the electrode layer, the piezoelectric layer deforms, causing a pressure variation in an ink in the ink passage so as to eject a droplet of the ink.

From the upper surface of the ejection actuator 30*b*, a flexible wiring board 72 extends upward, so as to be connected with the control unit 100, as shown in FIG. 3. The flexible wiring board 72 provides the electrode layer the drive signal for ejecting an ink droplet. The flexible wiring board 72 has wiring for transmitting an electrical signal. On the flexible wiring board 72, there is implemented a driver circuit board 73. The control unit 100 sends the driver circuit board 73 a control signal for the ink droplet ejection via the flexible wiring board 72, and upon receiving the control signal, the driver circuit board 73 converts the control signal into the drive signal which is sent to the ejection actuator 30*b*. The driver circuit board 73 extends vertically as well as along the auxiliary scanning direction, and has a shape long in the auxiliary scanning direction. A first surface of the driver circuit 73 which is opposed to the flexible wiring board 72 extends along a surface perpendicular to the main scanning direction. A second surface of the driver circuit 73 opposite to the first surface with respect to the auxiliary scanning direction also extends along the surface perpendicular to the main scanning direction.

In the carriage 9, there is disposed a heatsink 71 for preventing overheat of the driver circuit board 73. The heatsink 71 extends in the auxiliary scanning direction, as shown in FIGS. 3 and 4. The heatsink 71 is disposed between the driver circuit board 73 and the sub tank 31 in the main scanning direction. A surface of the heatsink 71 opposed to the driver circuit board 73 extends along a surface of the driver circuit board 73 and is in close contact with the driver circuit board 73. To maintain the close contact between the heatsink 71 and the driver circuit board 73, the heatsink 71 is fixed to the driver circuit board 73 by being bonded thereto with an adhesive or others. Alternatively, the close contact may be maintained by an elastic member or others that applies a biasing force to the heatsink 71. With the heatsink 71 and the driver circuit board 73 thus held in close contact, heat generated at the driver circuit board 73 is transferred to the heatsink 71 with stability.

As shown in FIG. 4, a void 71*a* is formed in the heatsink 71. The void 71*a* extends in the auxiliary scanning direction, and opens at two opposite ends of the heatsink 81 with respect to the auxiliary scanning direction. That is, the void 71*a* has two openings at the opposite ends of the heatsink 81. One of two ends of an air tube 75 (as a first gas passage) and one of two ends of an air tube 76 (as a second gas passage) are respectively connected with the two openings of the void 71*a*. The other end of the air tube 75 is connected with the sub tank 31. The other end of the air tube 76 is connected with an opening 77*a* of a mist catching device 77 fixed on an inner side surface of the carriage 9, which opening 77*a* opens toward the inner side of the carriage 9. The mist catching device has an internal space 77*b* in communication with the opening 77*a*, and thus the internal space 77*b* opens toward the inner side of the carriage 9. A side wall of the carriage 9 has a communication hole 9*a* that is in communication with the internal space 77*b* and opens toward an external space of the carriage 9. In the communication hole 9*a*, a filter 78 formed of a porous material or others is attached in order to cover an opening (as a mist suction opening) of the internal space 77*b* on the side of the inner side surface of the carriage 9.

Figure 5:
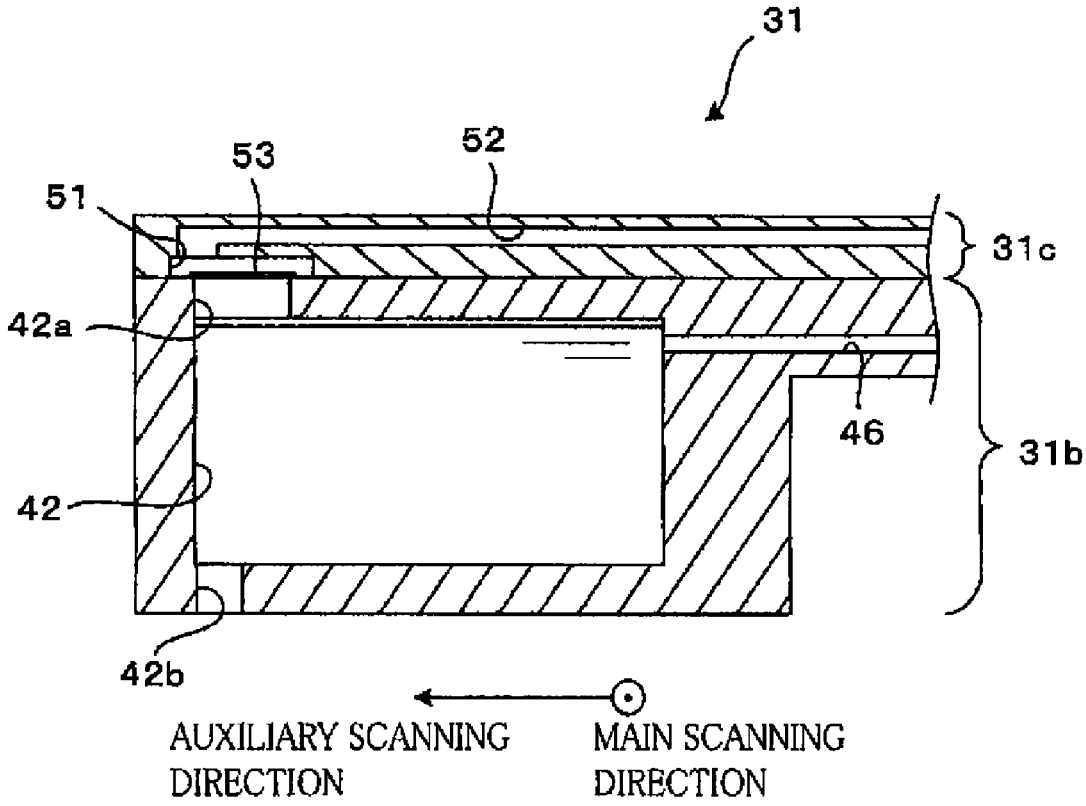
FIG. 5 is a vertical cross-sectional view of the sub tank taken along line 5-5 in FIG. 4.

There will be described an internal structure of the sub tank 31, with reference to FIGS. 4 and 5. In FIG. 4, the internal structure of the sub tank 31 is indicated by broken line. FIG. 5 is a vertical cross-sectional view of the sub tank 31 taken along line 5-5 in FIG. 4.

The sub tank 31 has a tank mainbody 31*b* and a lid member 31*c*, as shown in FIG. 5. In the tank mainbody 31*b* are formed ink storage chambers 41-44 (as liquid storing chambers) in which the inks are respectively stored, as shown in FIG. 4. In the tank mainbody 31*b* are further formed ink passages 45-48 for introducing the inks from the ink tubes 14*a*-14*d* into the ink storage chambers 41-44. That is, the inks supplied from the main tanks 5*a*-5*d* through the ink tubes 14*a*-14*d* flow into the ink storage chambers 41-44 via the ink introduction passages 45-48. The ink storage chambers 41-44 store the inks of respective colors, i.e., Bk, C, M and Y. It is noted that although in FIG. 5 only one 42 of the ink storage chambers 41-44 is shown, the ink storage chambers 41-44 are common in structure, that is, have a structure shown in FIG. 5, unless otherwise specifically stated.

The ink storage chambers 41-44 substantially have the shape of a rectangular parallelepiped that is long in the auxiliary scanning direction, and are arranged along the main scanning direction. The ink storage chambers 42-44 have a same inner volume and the ink storage chamber 41 has an inner volume larger than that of the other ink storage chambers 42-44. This is because that the ink storage chamber 41 stores the ink of Bk, or the black ink, which is generally depleted sooner than the other inks, i.e., the inks of cyan (C), magenta (M), and yellow (Y), and thus the ink storage chamber 41 is required to be able to store a larger amount of ink than the other ink storage chambers 42-44 are.

In the tank mainbody 31*b* and above the ink storage chambers 41-44, there are formed communication holes 41*a*-44*a*. An upper surface of the tank mainbody 31*b* extends along a horizontal surface, and the communication holes 41*a*-44*a* open in the upper surface of the tank mainbody 31*b*. To the upper surface of the tank mainbody 31*b*, a gas-permeable film 53 is bonded with an adhesive or others such that the gas-permeable film 53 covers or closes opening ends of the communication holes 41*a*-44*a*. The gas-permeable film 53 allows gas to pass therethrough, but does not allow other materials, such as ink and solid material, to pass therethrough. For instance, the gas-permeable film 53 is formed of a porous fluororesin material.

In the tank mainbody 31*b*, and at bottoms of the ink storage chambers 41-44, there are formed ink outlet passages 41*b*-44*b* for therethrough supplying the inks to the head mainbody 30. The ink outlet passages 41*b*-44*b* are in communication with upper ends or inlet ends of the ports 30*c* open in the upper surface of the head mainbody 30. For facilitating comprehension, in FIG. 4 the ink outlet passages 41*b*-44*b* are not shown, and in FIG. 5 only one 42*b* of the ink outlet passages 41*b*-44*b* is shown.

In the lid member 31*c*, the air chamber 51 (as a gas chamber) and an air passage 52 (as a suction passage) are formed. In plan view, the air chamber 51 has a rectangular shape long in the main scanning direction. More specifically, the air chamber 51 is a recessed portion in the lid member 31*c* that is open in a lower surface of the lid member 31*c*, and extends in the main scanning direction across the ink storage chambers 41-44. The air chamber 51 communicates with one of two opposite ends of the air passage 52. The other end of the air passage 52 communicates with the air tube 19. In the air passage 52, a pressure control device 90 is disposed in order to control an internal pressure of the air passage 52. The pressure control device 90 is in communication with the air tube 75 as well as the air passage 52.

Figure 6A:
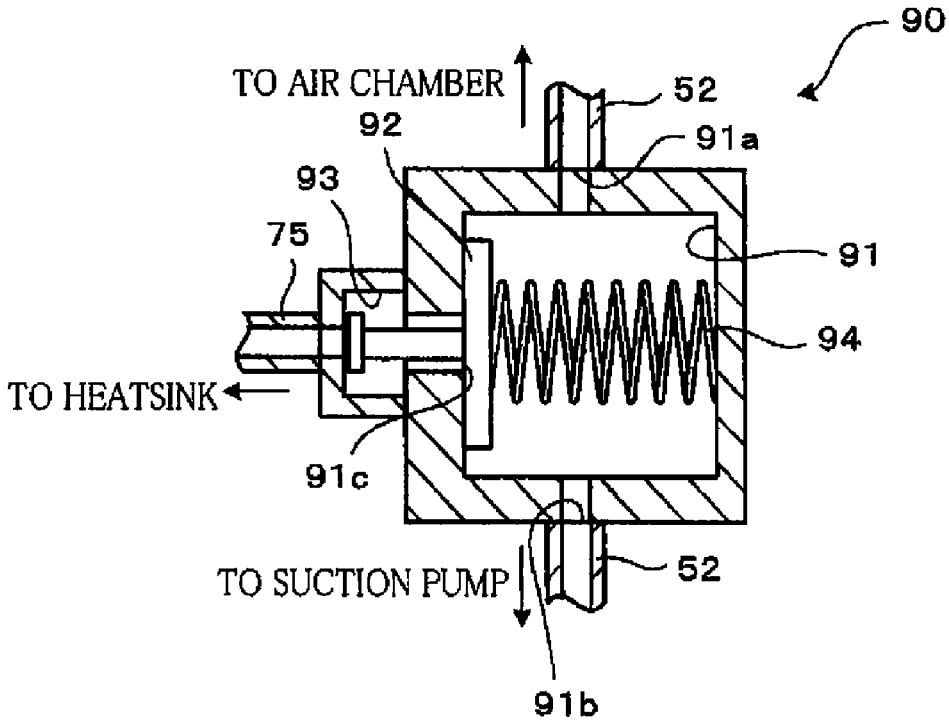
FIGS. 6A and 6B are horizontal cross-sectional views of a pressure control device shown in FIG. 4.
Figure 6B:
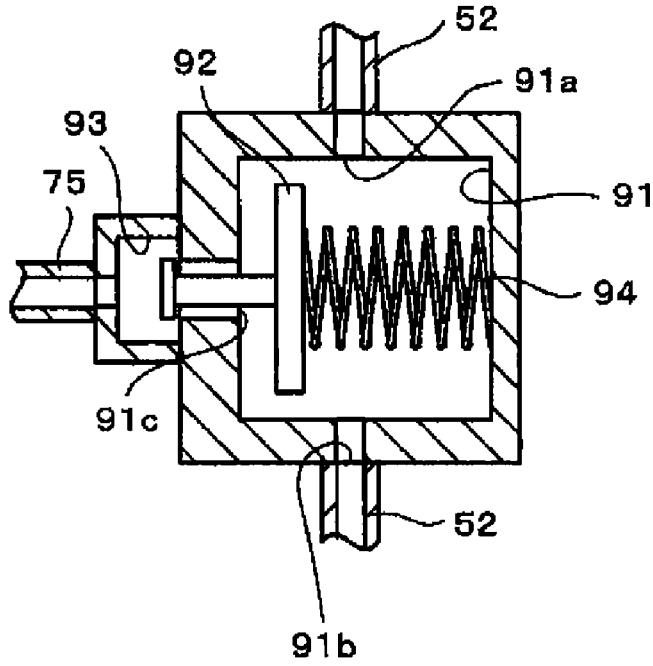

FIGS. 6A and 6B are horizontal cross-sectional views of the pressure control device 90, inside which a pressure control chamber 91 is formed. The pressure control chamber 91 has three ports 91*a*, 91*b* and 91*c* (as a first port, a second port, and a third port, respectively). With the port 91*a*, a part of the air passage 52 on the side of the air chamber 51 is communicated. With the port 91*b*, the other part of the air passage 52 on the side of the suction pump 81 is communicated. With the port 91*c*, the air tube 75 is communicated via a valve chamber 93. In the pressure control chamber 91, a biasing member 94 and a part of a valve element 92 are accommodated. The valve element 92 is disposed to extend through a communication portion at which the pressure control chamber 91 and the valve chamber 93 can communicate with each other. The valve element 92 is movable between a closing position (shown in FIG. 6A) to close the port 91*c*, and an opening position (shown in FIG. 6B) to open the port 91*c*.

The biasing member 94 biases the valve element 92 to the closing position with a biasing force that is set such that the valve element 92 moves between the opening position and the closing position in accordance with an internal pressure of the pressure control chamber 91. While the internal pressure of the pressure control chamber 91 is equal to or higher than a second threshold lower than the atmospheric pressure, the valve element 92 is held at the closing position. When the internal pressure of the pressure control device 91 decreases below the second threshold, a difference between an internal pressure of the valve chamber 93 and that of the pressure control chamber 91 becomes so large that the biasing force of the biasing member 94 to hold the valve element 92 at the closing position is overcome by the pressure difference and the valve member 92 moves from the closing position to the opening position. In this way, the port 91*c* is placed in one of an opening state and a closed state depending on the internal pressure of the pressure control chamber 91. On the other hand, the ports 91*a* and 91*b* are always in an open state, that is, the part of the air passage 52 on the side of the air chamber 51 and the other part of the air passage 52 on the side of the suction pump 81 are held communicated with each other across or via the pressure control chamber 91.

The second threshold is set at a value between a limit value of a negative pressure at which the gas-permeable film 53 may come off of an inner surface of the air chamber 51 or be damaged, and a third threshold described later.

Figure 7A:
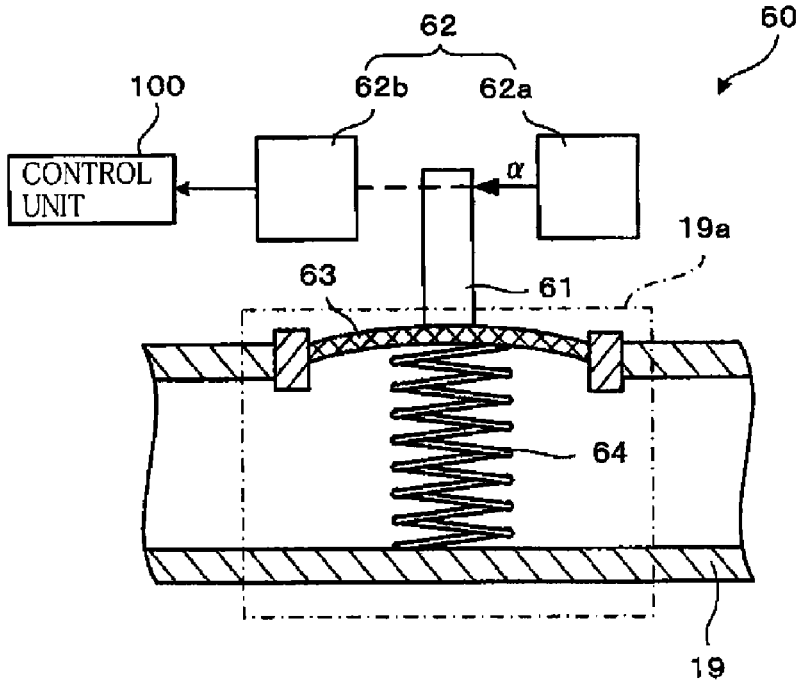
FIGS. 7A and 7B are views showing a pressure detecting device shown FIG. 1 and its vicinity.
Figure 7B:
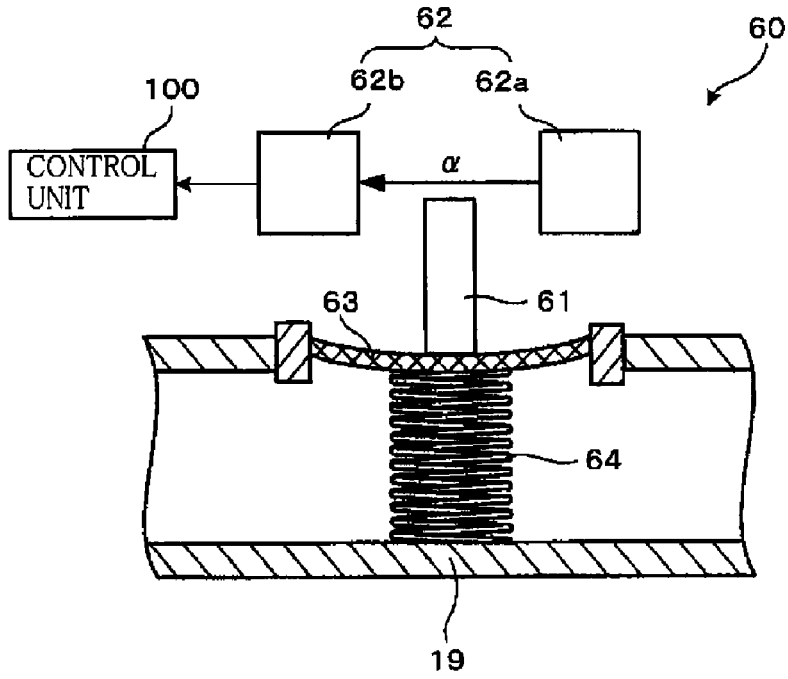

There will be described the pressure detecting device 60 with reference to FIGS. 7A and 7B. The air tube 19 includes an expandable portion 19*a* at which a part of a wall of the air tube 19 is flexible and expands and contracts in accordance with change in the internal pressure of the air tube 19. The pressure detecting device 60 includes an optical sensor 62 disposed on the outer side of the expandable portion 19*a* and a shield plate 61. The optical sensor 62 has a light emitting portion 62*a* that emits light $\alpha$, and a light receiving portion 62*b* including a light receiving element disposed on a line extended along a path of the emitted light $\alpha$. The light receiving portion 62*b* outputs to the control unit 100 a signal indicative of an intensity of the light that the light receiving portion 62*b* receives.

The flexible part of the wall of the air tube 19 in the expandable portion 19*a* is opposed to the optical sensor 62 and formed of an elastic film 63 formed of an elastic material more easily deformable in correspondence with change in the internal pressure of the air tube 19 than a material forming the other part of the air tube 19. In the expandable portion 19*a*, there is disposed a biasing member 64 that biases the elastic film 63 toward the optical sensor 62. Hence, the elastic film 63 is deformed to protrude toward the optical sensor 62, as shown in FIG. 7A, when the internal pressure of the air tube 19 is at the atmospheric pressure. As the internal pressure of the air tube 19 decreases from the atmospheric pressure, the elastic film 63 inwardly deforms against the biasing force of the biasing member 64 due to a difference between an external pressure and an internal pressure of an air passage formed inside the air tube 19 and the pressure limit 69.

To an outer surface of the elastic film 63, the shield plate 61 is fixed. The position at which the shield plate 61 is fixed is such that as the elastic film 63 deforms as described above, the shield plate 61 moves from a first position (shown in FIG. 7A) that corresponds to a detection position on the path of the light $\alpha$ to block the light $\alpha$, to a second position (shown in FIG. 7B) apart from the first position. Further, the biasing force of the biasing member 64 is set such that when the internal pressure of the air tube 19 is equal to or higher than the third threshold lower than the first threshold, the shield plate 61 blocks the light α, and when the internal pressure of the air tube 19 is lower than the third threshold, the shield plate 61 is off the path of the light α. Thus, the control unit 100 can determine whether the shield plate 61 is located on the path of the light α or not, on the basis of the intensity of the received light, of which the signal from the light receiving portion 62*b* is indicative. Based on a result of this determination, the control unit 100 can determine whether the internal pressure of the air tube 19 is lower than the third threshold.

Figure 8A:
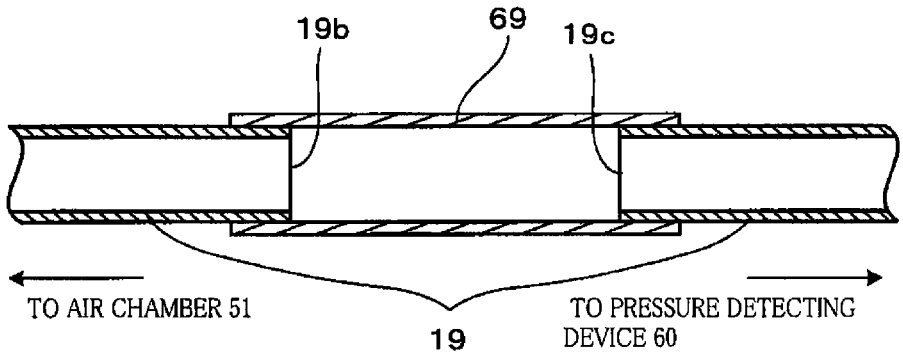
FIGS. 8A and 8B are horizontal cross-sectional views of a pressure limiter shown in FIG. 1.
Figure 8B:
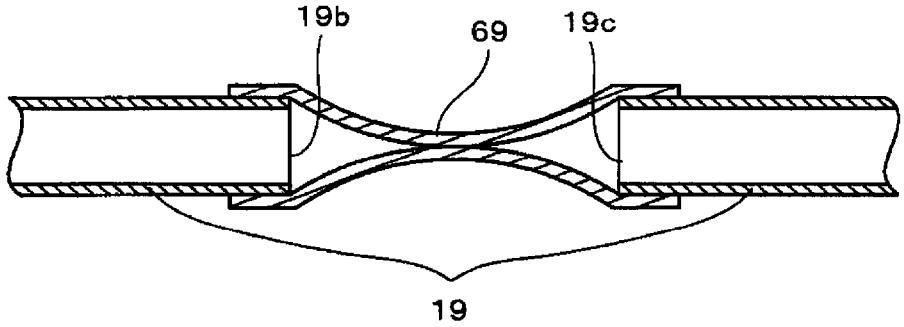

There will be described the pressure limiter 69 disposed in the air tube 19, with reference to FIGS. 8A and 8B. The pressure limiter 69 is a tubular member having a size enabling fitting of the air tube 19 therein. In one of two opposite ends of the pressure limiter 69, a first open end portion 19*b* of the air tube 19 on the side of the air chamber 51 is fitted. In the other end of the pressure limiter 69, a second open end portion 19*c* of the air tube 19 on the side of the pressure detecting device 60 is fitted. The pressure limiter 69 is formed of an elastic material that is more deformable in accordance with a difference between an internal pressure and an external pressure of the pressure limiter 69 than the material forming the air tube 19 is. Thus, in a natural state (shown in FIG. 8A) of the pressure limiter 69, the internal pressure thereof is at the atmospheric pressure, and as the internal pressure of the pressure limiter 69 decreases from the atmospheric pressure, the pressure limiter 69 becomes thinner or a wall of the pressure limiter 69 is drawn radially inward. It is adjusted such that when the internal pressure of the pressure limiter 69 decreases to the limit value, an internal space of, or the air passage inside, the pressure limiter 69 is completely closed as shown in FIG. 8B.

There will be described in further detail control implemented by the control unit 100. The control unit 100 implements an air-chamber suction processing for having the suction pump 81 suck the air chamber 51. This air-chamber suction processing will be described. When these tubes 16, 18 are not communicated with each other, the control unit 100 initially controls the flow-path switching device 82 to establish a communication between the air tubes 16 and 18. By this, the suction pump 81 and the air chamber 51 are communicated with each other, via the air tubes 16, 18, the charge tank 84, the air tube 19, and the air passage 52. Then, the suction pump 81 is operated to suck the air from the air chamber 51 until it is determined on the basis of the result of the detection by the pressure detecting device 60 that the internal pressure of the air tube 19 is negative and lower than the third threshold. In this way, the suction pump 81 functions as a means for producing a negative pressure.

At a point in the air tube 18, the check valve 83 is disposed, and the air flow in the air tube 18 is limited to a direction from the charge tank 84 to the flow-path switching device 82. Hence, even when the operation of the suction pump 81 is stopped or the flow path is switched by operating the flow-path switching device 82, after the air-chamber suction processing, air flow into the air chamber 51 is inhibited, thereby enabling to hold the internal pressure of the air chamber 51 below the third threshold.

Since the air chamber 51 and the ink storage chambers 41-44 are defined on the opposite sides of the gas-permeable film 53, the air in the ink storage chambers 41-44 can be separated from the inks (i.e., the gas-liquid separation is implemented) and sucked into the air chamber 51 through the gas-permeable film 53, by the internal pressure of the air chamber 51 held negative. The above-described third threshold is set such that a sufficient degree of gas-liquid separation between the air and the inks can be achieved by the sucking of the air from the ink storage chambers 41-44 through the gas-permeable film 53. Thus, holding the internal pressure of the air chamber 51 below the third threshold, the gas-liquid separation in the ink storage chambers 41-44 is maintained, thereby inhibiting the air flow from the ink storage chambers 41-44 into the head mainbody 30.

On the basis of the result of the detection by the pressure detecting device 60, the control unit 100 can determine whether the internal pressure of the air chamber 51 is below the third threshold or not. Hence, it is possible to implement a control such that the control unit 100 operates to have the suction pump 81 suck the air chamber 51 until the internal pressure of the air chamber 51 decreases below the third threshold, which is detected by the pressure detecting device 60.

On the basis of the result of the detection by the pressure detecting device 60, the control unit 100 implements various other control processings, too. There will be described these control processings.

Figure 9:
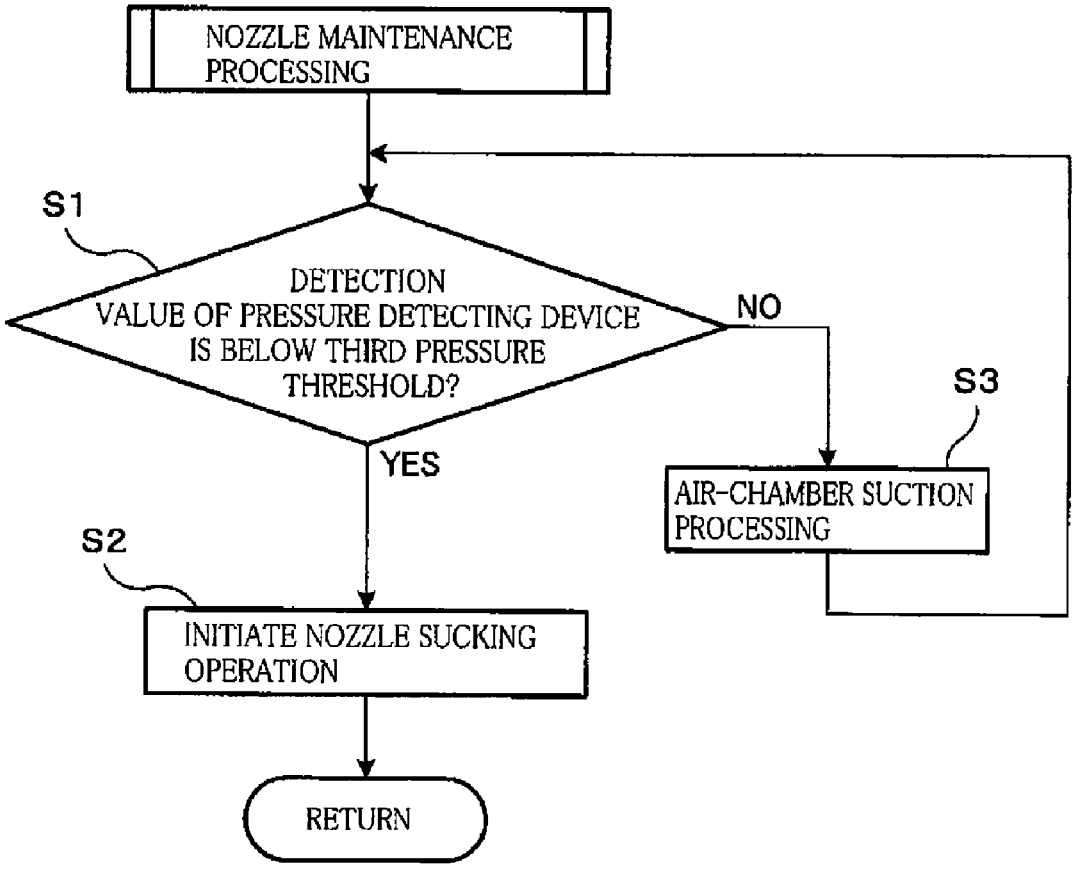
FIG. 9 is a flowchart illustrating a nozzle maintenance processing implemented by a control unit of the inkjet printer.

A first one of the other control processings is a nozzle maintenance processing that is illustrated in the form of a flowchart in FIG. 9. The processing flow starts with step S1 in which the control unit 100 determines, on the basis of the intensity of the light α which the signal from the light receiving portion 62*b* of the pressure detecting device 60 is indicative of, whether the internal pressure of the air tube 19 is below the third threshold. When the control unit 100 determines that the internal pressure of the air tube 19 is not below the third threshold, a negative decision (NO) is made in step S1 and the processing flow goes to step S3 in which the control unit 100 implements the air-chamber suction processing. Until the internal pressure of the air tube 19 decreases below the third threshold, steps S1 and S3 are repeatedly implemented, in other words, the air-chamber suction processing is continued.

When the control unit 100 determines in step S1 that the internal pressure of the air tube 19 is below the third threshold, an affirmative decision (YES) is made and the processing flow goes to step S2 in which the control unit 100 initiates a nozzle sucking operation. The nozzle sucking operation is implemented as follows. First, the control unit 100 controls the flow-path switching device 82 to communicate the air tube 16 with the air tube 17*a*. With the communication between the air tubes 16 and 17*a* established, the suction pump 81 and an internal space of the suction cap 21 are in communication with each other via the air tubes 16, 17*a* and the suction opening 21*a*.

Then, the control unit 100 operates to move the carriage 9 to the maintenance position over the capping device 20, and control the capping device 20 to move the suction cap 21 to the covering position to seal the nozzles 30*a*. After the nozzles 30*a* are thus covered by the suction cap 21, the control unit 100 controls the suction pump 81 to suck the internal space of the suction cap 21. Since the suction cap 21 covers the nozzles 30*a* with its two protrusions 21*b*, the air tube 17*a* is in communication with an internal space of one of the protrusions 21*b*. Hence, at this time, ink is sucked from a group of nozzles 30*a* surrounded by the one protrusion 21*b* in plan view. Thereafter, the control unit 100 controls the flow-path switching device 82 to communicate the air tubes 16, 17*b* with each other, and have the suction pump 81 suck from the internal space of the suction cap 21. By this, ink is sucked this time from the other group of nozzles 30*a* surrounded by the other protrusion 21*b* in plan view. By implementation of the nozzle sucking operation, waste ink on the lower surface of the head mainbody 30 around the nozzles 30*a*, and air having been introduced in the ink passages, are eliminated. According to the nozzle sucking operation, the nozzles 30*a* surrounded or covered by the protrusion 21*b* and the nozzles 30*a* surrounded or covered by the protrusion 21*c* can be subjected to the suction by the suction pump 81 independently of each other.

As described above, according to the nozzle maintenance processing, the air-chamber suction processing is implemented when it is determined on the basis of the result of the detection by the pressure detecting device 60 that the internal pressure of the air chamber 51 is equal to or higher than the third threshold, and the suction of the air chamber 51 (i.e., the air-chamber suction processing) is continuously implemented until the internal pressure of the air chamber 51 decreases below the third threshold. When the internal pressure of the air chamber 51 has decreased below the third threshold, the nozzle sucking operation is initiated. Hence, it is inhibited that the nozzle sucking operation is initiated before the internal pressure of the air chamber 51 decreases below the third threshold. That is, it is inhibited that the nozzle sucking operation is implemented before the gas-liquid separation in the ink storage chambers 41-44 is not achieved to a sufficient degree, which would otherwise undesirably cause inflow of the air into the head mainbody 30 from the ink storage chambers 41-44.

Figure 10:
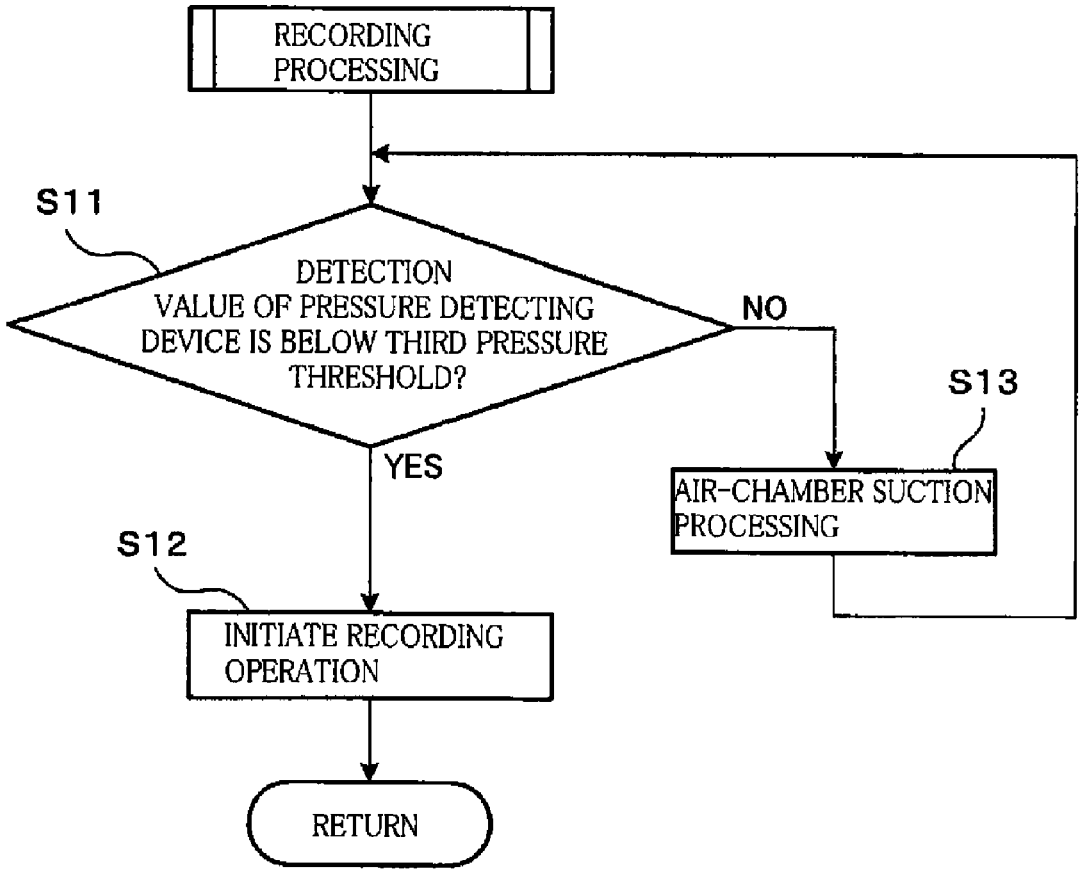
FIG. 10 is a flowchart illustrating a recording processing implemented by the control unit.

A second one of the other control processings implemented based on the result of the detection by the pressure detecting device 60 is a recording processing, which is illustrated in FIG. 10 in the form of a flowchart. The recording processing is initiated with step S11 in which the control unit 100 determines, on the basis of the intensity of the light that the signal from the light receiving portion 62*b* of the pressure detecting device 60 is indicative of, whether the internal pressure of the air tube 19 is below the third threshold. When it is determined that the internal pressure of the air tube 19 is not below the third threshold, a negative decision (NO) is made in step S11 and the processing flow goes to step S13 in which the control unit 100 implements the air-chamber suction processing. Thereafter, until the internal pressure of the air tube 19 decreases below the third threshold, steps S11 and S13 are repeatedly implemented, in other words, the air-chamber suction processing is continued. When it is determined that the internal pressure of the air tube 19 has decreased below the third threshold, an affirmative decision (YES) is made in step S11 and the processing flow goes to step S12 in which the control unit 100 initiates a recording operation.

As described above, in the recording processing, the air-chamber suction processing is implemented when it is determined on the basis of the result of the detection by the pressure detecting device 60 that the internal pressure of the air chamber 51 is equal to or higher than the threshold, and the sucking the air from the air chamber 51 (i.e., the air-chamber suction processing) is continued until the internal pressure of the air chamber 51 decreases below the third threshold. When the internal pressure of the air chamber 51 has decreased below the third threshold, the recording operation is initiated. Hence, it is inhibited that the recording operation is initiated before the internal pressure of the air chamber 51 decreases below the third threshold. This in turn inhibits air flow from the ink storage chambers 41-44 into the head mainbody 30 due to a recording operation implemented while the gas-liquid separation in the ink storage chambers 41-44 is not achieved in a sufficient degree.

The sucking the air from the air chamber 51 by the suction pump 81 may be continued even after initiation of the recording operation, or may be terminated when the recording operation is initiated. Even when the sucking is terminated when the recording operation is initiated, the check valve 83 operates to hold the internal pressure of the air chamber 51 negative, as described above. After initiation of the recording operation, droplets of the inks are ejected from the nozzles 30*a*, and a portion of the inks in the main tanks 5*a*-5*d* moves or flows into the ink storage chambers 41-44 to replenish the ink storage chambers 41-44. At this time, the air included in the inks stored in the main tanks 5*a*-5*d* may also move or flow into the ink storage chambers 41-44 with the inks. However, according to the embodiment where the internal pressure of the air chamber 51 is held negative, the air thus introduced into the ink storage chambers 41-44 is separated from the inks in the ink storage chambers 41-44.

Figure 11:
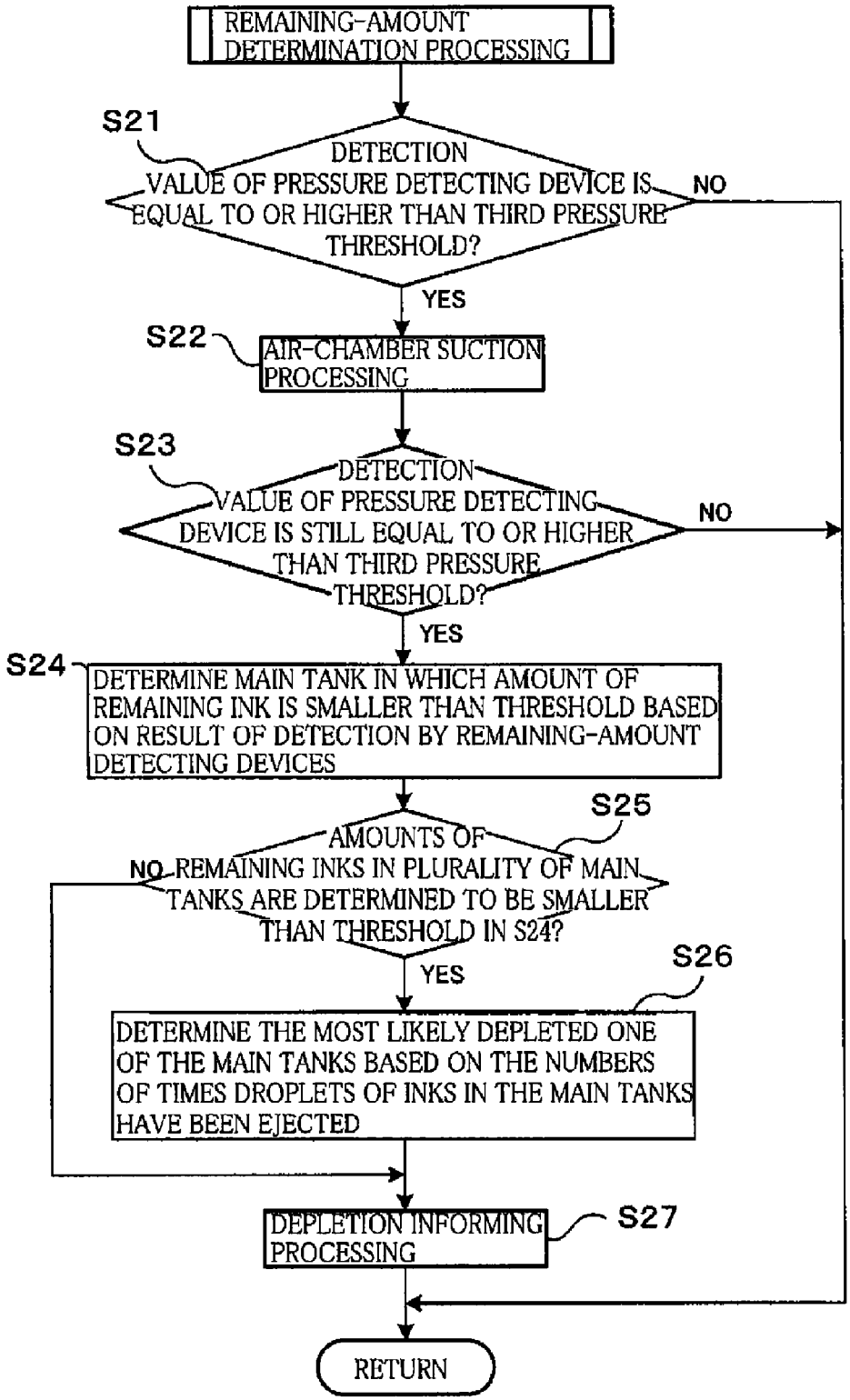
FIG. 11 is a flowchart illustrating a remaining-amount determination processing implemented by the control unit.

A third one of the other control processings implemented based on the result of the detection by the pressure detecting device 60 is a remaining-amount determination processing. Normally, once the internal pressure of the air chamber 51 is decreased to the third threshold by the air-chamber suction processing, the internal pressure of the air chamber 51 is held at the third threshold by the operation of the check valve 83. When the ink in any one of the main tanks 5*a*-5*d* is depleted, a large amount of air flows into the corresponding ink storage chamber 41-44, resulting in increase in the internal pressure of the air chamber 51 to or beyond the atmospheric pressure. Hence, when the result of the detection by the pressure detecting device 60 after the air-chamber suction processing indicates that the internal pressure of the air chamber 51 is equal to or higher than the third threshold, this may means that ink in one of the main tanks 5*a*-5*d* is depleted. Based on this, the control unit 100 implements the remaining-amount determination processing. FIG. 11 is a flowchart illustrating the remaining-amount determination processing.

The remaining-amount determination processing starts with step S21 in which the control unit 100 determines on the basis of the result of the detection by the pressure detecting device 60 whether the internal pressure of the air chamber 51 is equal to or higher than the third threshold. When it is determined that the internal pressure is neither equal to nor higher than the third threshold, a negative decision (NO) is made in step S21 and the control unit 100 determines that no main tanks 5*a*-5*d* are depleted and the remaining-amount determination processing of this cycle is terminated. On the other hand, when the internal pressure of the air chamber 51 is equal to or higher than the third threshold and an affirmative decision (YES) is made in step S21, the processing flow goes to step S22 in which the control unit 100 implements the air-chamber suction processing. Thereafter, the processing flow goes to step S23 in which the control unit 100 again determines on the basis of the result of the detection by the pressure detecting device 60 whether the internal pressure of the air chamber 51 is still equal to or higher than the third threshold. When it is determined that the internal pressure of the air chamber 51 is restored to a level below the third threshold and a negative decision (NO) is made in step S23, it is determined that no main tanks 5*a*-5*d* are depleted but the internal pressure of the air chamber 51 only temporarily becomes equal to or higher than the third threshold, and the remaining-amount determination processing of this cycle is terminated.

On the other hand, when it is determined that the internal pressure of the air chamber 51 is still equal to or higher than the third threshold and an affirmative decision (YES) is made in step S23, the control unit 100 determines that at least one of the main tanks 5*a*-5*d* is depleted. Then, the processing flow goes to step S24 in which the control unit 100 determines, on the basis of the result of the detection by the remaining-amount detecting devices 6*a*-6*d*, which main tank 5*a*-5*d* is empty. More specifically, when at least one of the main tanks 5*a*-5*d* is depleted, the result of the detection by the remaining-amount detecting device 6*a*-6*d* corresponding to the depleted main tank 5*a*-5*d* shall indicate that the main tank 5*a*-5*d* is empty or nearly empty. Hence, when the result of the detection by the remaining-amount detecting device 6*a*-6*d* corresponding to any one of the main tanks 5*a*-5*d* indicates that the main tank is empty or nearly empty, the control unit 100 determines that the main tank is depleted.

Then, the processing flow goes to step S25 in which the control unit 100 determines whether there are a plurality of the main tanks 5*a*-5*d* the amounts of the remaining inks in which are determined to be smaller than the threshold in step S24. When the amount of the remaining ink in only a single main tank 5*a*-5*d* is determined to be smaller than the threshold in step S24, a negative decision (NO) is made in step S25 and the processing flow goes to step S27. On the other hand, when the amounts of the remaining inks in a plurality of the main tanks 5*a*-5*d* are determined to be smaller than the threshold in step S24, an affirmative decision (YES) is made in step S25 and the processing flow goes to step S26, in which the control unit 100 refers to, with respect the main tanks 5*a*-5*d* in which the amounts of the remaining inks are determined to be smaller than the threshold in step S24, estimated ink amounts having been consumed since the remaining-amount detecting devices 6*a*-6*d* first indicated that the amounts of the remaining inks were below the threshold, that is, that the main tanks 5*a*-5*d* in question were nearly depleted. That is, in this embodiment, the numbers of times ink droplets have been ejected from the nozzles 30*a* corresponding to the respective main tanks 5*a*-5*d* in question are counted. The counts are used as values indicative of the estimated ink amounts consumed, based on which the one among the main tanks 5*a*-5*d* in question that is most likely depleted is determined. The main tank thus determined to be most likely depleted is determined to be the depleted one of the main tanks 5*a*-5*d*. Then, the processing flow goes to step S27 to implement a depletion informing processing for informing a user of the depletion of the main tank 5*a*-5*d* thus determined. The depletion informing processing is implemented for instance such that a character string or others indicating the determined main tank is presented on the display device.

There will be described an operation and effects of the present embodiment.

According to this embodiment, due to the operation of the check valve 83 as described above, the air is held separated from the inks in the ink storage chambers 41-44 even after sucking the air from the air chamber 51 is terminated. Hence, even where a recording operation or a nozzle sucking operation is initiated thereafter, air flow from the ink storage chambers 41-44 into the head mainbody 30 is inhibited.

Since the various control processings are implemented on the basis of the result of the detection by the pressure detecting device 60, it is enabled to implement the control to continuously suck the air from the air chamber 51 until the internal pressure thereof becomes lower than the third threshold, and a control to initiate a recording operation and a nozzle sucking operation when the internal pressure of the air chamber 51 has decreased below the first threshold.

In the remaining-amount determination processing, where it is determined that the result of the detection by the pressure detecting device 60 indicates that the internal pressure is equal to or higher than the third threshold, the same determination is repeatedly made after implementation of the air-chamber suction processing, and only when it is determined that the detection result indicates that the internal pressure is still equal to or higher than the third threshold, it is determined that at least one of the main tanks 5*a*-5*d* is depleted. Thus, in a case where air flow into the air chamber 51 merely temporarily occurs due to a cause other than depletion of at least one of the main tanks 5*a*-5*d*, an erroneous determination that at least one of the main tanks 5*a*-5*d* is depleted is not made. That is, it is determined with high accuracy that at least one main tank becomes depleted.

In the remaining-amount determination processing, after the determination of whether at least one of the main tanks 5*a*-5*d* is depleted is made based on the result of the detection by the pressure detecting device 60, a more specific determination, namely, a determination of whether there are a plurality of main tanks 5*a*-5*d* depleted or at least nearly depleted, is made on the basis of the result of the detection by the remaining-amount detecting device 6*a*-6*d*. When an affirmative decision is made in the latter determination, that is, when it is determined that a plurality of main tanks 5*a*-5*d* are depleted or at least nearly depleted, the one estimated to be most likely depleted among the main tanks 5*a*-5*d* determined to be depleted or at least nearly depleted is determined, on the basis of the numbers of times of ink droplet ejection. Thus, the depleted main tank can be determined with high precision and accuracy.

Between the air chamber 51 and the check valve 83, there is disposed and connected the charge tank 84, which has a cross-sectional area larger than those of the air tubes 18 and 19. Hence, as compared to a case where the air chamber 51 and the check valve 83 are connected with each other through an air tube only, an inner volume of an air passage between the air chamber 51 and the check valve 83 is increased. This means that an inner volume for accumulating pressure is increased, which is effective to prevent that the internal pressure of the air chamber 51 too frequently becomes equal to or higher than the first threshold, that is, that the internal pressure of the air chamber 51 becomes equal to or higher than the third threshold even when only a slight amount of air is introduced into the air chamber 51. Therefore, it is enabled to prolong a period of time during which the ink storage chambers 41-44 can be held in the state where the air is separated from the inks, or the gas-liquid separation is achieved.

In this embodiment where the pressure control device 90 is used, the port 91*c* opens when the internal pressure of the air chamber 51 becomes equal to or higher than the second threshold. The port 91*c* communicates with the external space of the inkjet head 8 via the air tube 75, the void 71*a* of the heatsink 71, the air tube 76, and the mist catching device 77. Hence, the air in the external space is taken into the pressure control chamber 91 via the port 91*c* to increase the internal pressure of the pressure control chamber 91. When the internal pressure of the air chamber 51 increases to or above the second threshold, the port 91*c* closes and the internal pressure no more increases. In this way, even when the internal pressure of the air chamber 51 becomes below the second threshold, for instance due to excessive sucking of the air from the air chamber 51 during the air-chamber suction processing, the pressure control device 90 operates to take the air in the external space into the air chamber 51, thereby restoring the internal pressure to the second threshold. Thus, the internal pressure of the air chamber 51 is prevented from becoming below the second threshold, which would otherwise impose an excessive pressure on the gas-permeable film 53 to cause the gas-permeable film 53 to come off or be damaged.

According to the pressure control device 90, when the port 91*c* is opened, the air is taken in from the external space of the inkjet head 8 through the mist catching device 77. The filter 78 formed of a porous material or other materials is attached at the opening of the mist catching device 77. When ink droplets are ejected from the nozzles 30*a* during a recording operation, a large number of minute ink droplets may waft around the inkjet head 8, in other words, so-called "ink mist" may occur. When the ink mist enters the inkjet head 8 and contacts an electric circuit or others, a short circuit or a malfunction of an ejection actuator 30*b* may occur. However, according to this embodiment, when the air is taken in through the mist catching device 77, the ink mist is caught by the filter 78 attached at the opening of the mist catching device 77, thereby reducing the ink mist wafting around the inkjet head 8. Although the ink mist can be sucked into the mist catching device 77 even without the filter 78 attached at the opening of the mist catching device 77, the arrangement where the filter 78 is used is effective to prevent clogging of an air passage inside the air tube 75 and the heatsink 71 due to ink flowing into the air tube 75 and the void 71*a* of the heatsink 71. Since sucking by the suction pump 81 is utilized to catch the ink mist, it is unnecessary to dispose a suction pump dedicated to catching the ink mist.

The air that is introduced through the mist catching device 77 while the port 91*c* is open then passes through the void 71*a* in the heatsink 471. Hence, heat having been transferred to the heatsink 71 from a driver circuit board 73 is drawn or removed from the heatsink 471 by the air flow through the void 71*a*. Since the void 71*a* is formed along a direction of extension of the driver circuit board 73 (i.e., the auxiliary scanning direction), the heat generated by the driver circuit board 73 is efficiently removed. Further, since sucking by the suction pump 81 is utilized for the removal of the heat from the heatsink 71, it is unnecessary to dispose a suction pump dedicated to cooling the heatsink 71.

It is possible to continuously operate the suction pump 81 so as to continue cooling the heatsink 71 as well as catching the ink mist by the mist catching device 77.

At a point in the air tube 19 is disposed the pressure limiter 69 which deforms to inhibit air flow along the internal space of the air tube 19 when the internal pressure of the air tube 19 decreases to the limit value lower than the second threshold. Therefore, even when the internal pressure of the air chamber 51 deceases far below the second threshold during the air-chamber suction processing, for instance due to a false operation of the pressure control device 90 or the pressure detecting device 60, the pressure limiter 69 closes the internal space of the air tube 19 in order to prevent the internal pressure of the air chamber 51 from decreasing below the limit value.

Figure 12:
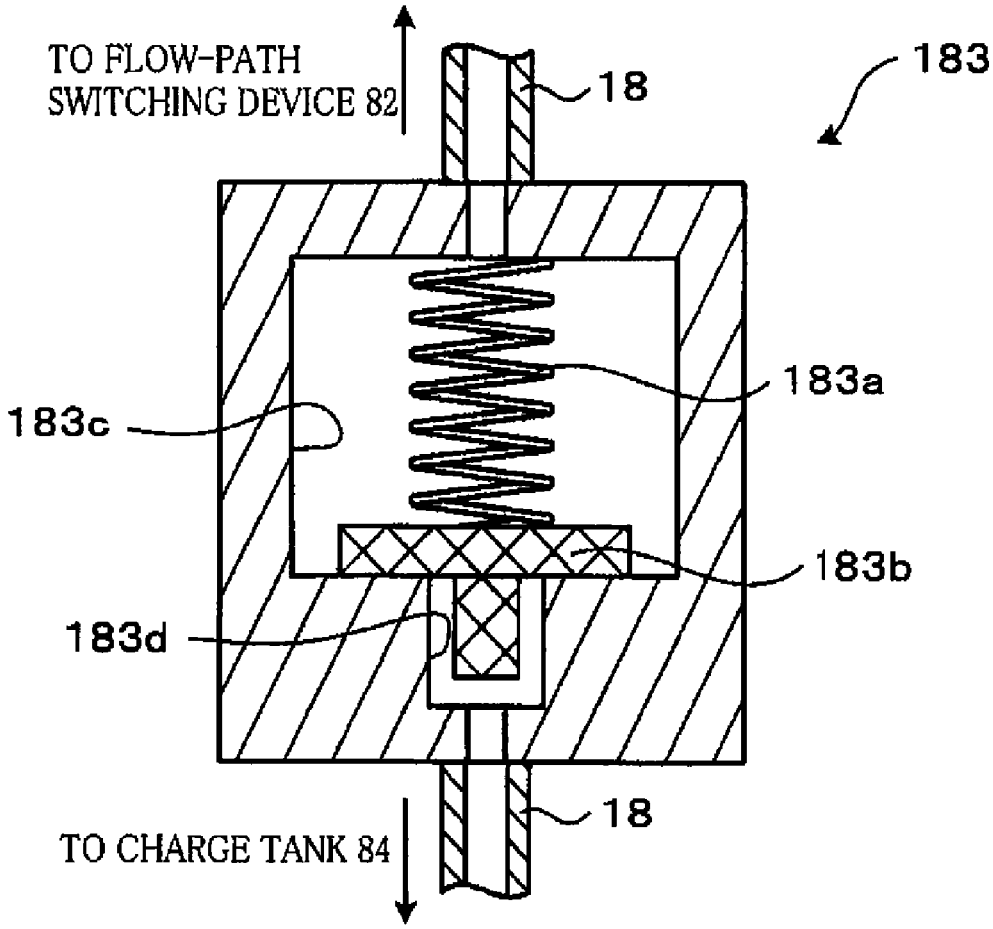
FIG. 12 is a cross-sectional view of a check valve in an inkjet printer according to a second embodiment.

Referring to FIG. 12, there will be described an inkjet printer according to a second embodiment of the invention, which differs from the first embodiment in the check valve. More specifically, in the second embodiment, a check valve 183 is employed in place of the check valve 83. As shown in FIG. 12, which is a cross-sectional view of the check valve 183, a first valve chamber 183*c* and a second valve chamber 183*d* are formed in the check valve 183. The first valve chamber 183*c* is communicated with an air tube 18 on the side of a flow-path switching device 82, and the second valve chamber 183*d* is communicated with the air tube 18 on the side of the charge tank 84. In the first and second valve chambers 183*c* and 183*d*, a valve element 183*b* is accommodated. The valve element 183*b* is movable between a closing position to close a communication portion between the first and second valve chambers 183*c*, 183*d* for disconnecting communication therebetween, and an opening position to open the communication portion for allowing the communication. In the first valve chamber 183*c* is disposed a biasing member 183*a* which biases the valve element 183*b* to the closing position. A biasing force of the biasing member 183*a* is adjusted such that when an internal pressure of the second valve chamber 183*d* is below the first threshold, the valve element 183*b* is at the closing position, and when the internal pressure of the second valve chamber 183*d* is equal to or higher than the first threshold, the valve element 183*b* is movable between the closing and opening positions. Thus, like the check valve 83 in the first embodiment, the check valve 183 can limit air flow in the air tube 18 to a direction from the charge tank 84 to the flow-path switching device 82.

Figure 13A:
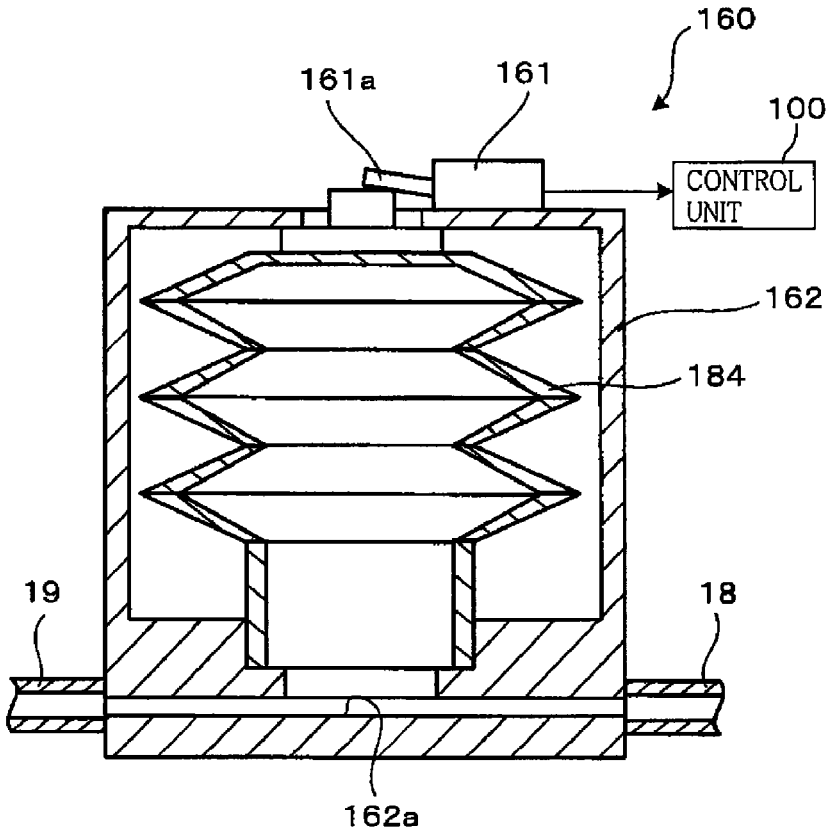
FIGS. 13A and 13B are views of a pressure detecting device in an inkjet printer according to a third embodiment.
Figure 13B:
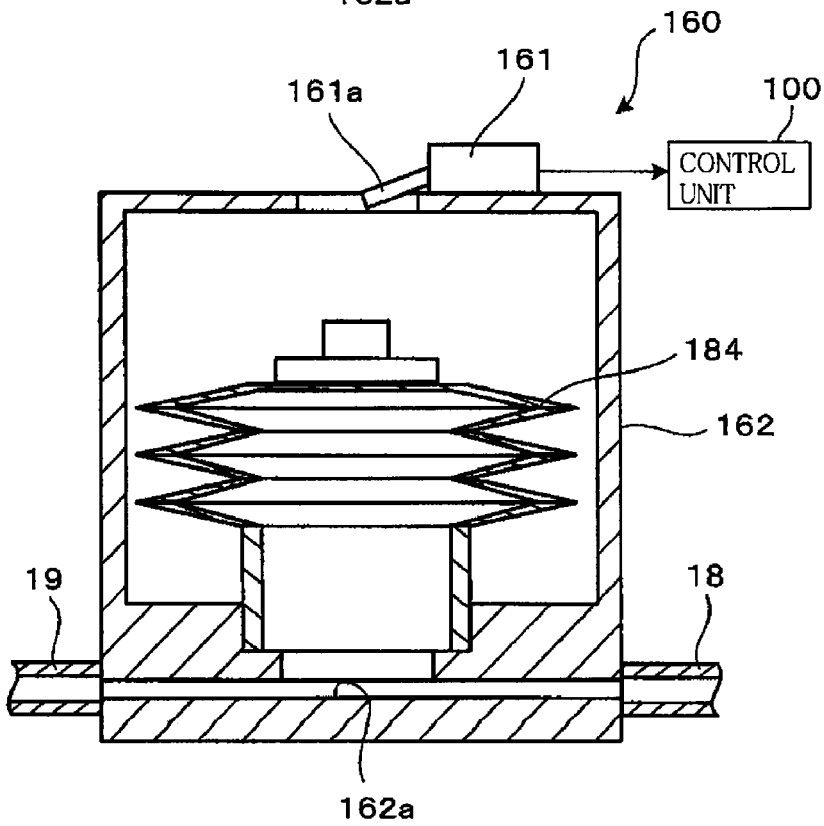

By referring to FIGS. 13A and 13B, there will be described an inkjet printer according to a third embodiment, which differs from the first embodiment in the pressure detecting device. That is, in the third embodiment, a pressure detecting device 160 is employed in place of the pressure detecting device 60. FIGS. 13A and 13B are cross-sectional views of the pressure detecting device 160. In the third embodiment, the pressure detecting device 160 is disposed along with a bellows tank 184 which is employed in place of the charge tank 84 in the first embodiment. The pressure detecting device 160 includes a detection tank 162 and the bellows tank 184 disposed in the detection tank 162. The bellows tank 184 has the shape of a bellows, and is vertically movable or deformable in accordance with an internal pressure thereof and fixed on a bottom surface of the detection tank 162. In the detection tank 162 is formed an air passage 162*a* which is communicated with air tubes 18, 19 and an internal space of the bellows tank 184.

The detection tank 162 is open upward, and a switch device 161 is fixed on an upper surface of the detection tank 162. The switch device 161 includes a switch lever 161*a*, which is switchable between a first state shown in FIG. 13A and a second state shown in FIG. 13B. In the first state, the switch lever 161*a* is inclined with a distal end thereof located on the upper side. In the second state, the switch lever 161*a* is inclined with the distal end located on the lower side. The switch device 161 has a means for biasing the switch lever 161*a* in a direction to place the switch lever 161*a* in the second state. The switch device 161 sends a control unit 100 a detection signal indicative of which of the first and second states the switch lever 161*a* is in.

When the internal pressure of the bellows tank 84 is at the atmospheric pressure, an upper end of the bellows tank 184 is in contact with the switch lever 161*a*, as shown in FIG. 13A, thereby holding the switch lever 161*a* in the first state. As the internal pressure of the bellows tank 184 decreases, the bellows tank 84 downward contracts, and when the internal pressure decreases to the third threshold, the upper end of the bellows tank 84 separates from the switch lever 161*a*, thereby placing the switch lever 161*a* in the second state.

According to this embodiment, the control unit 100 can determine whether the switch lever 161*a* is in the second state on the basis of the detection signal from the pressure detecting device 160, and in turn can determine whether the internal pressure of the bellows tank 184 is below the third threshold or not. Since the bellows tank 184 can expand and contract, the bellows tank 184 can accumulate negative pressure.

The port 91*c* of the pressure control device 90 is in communication with the heatsink 71 and the mist catching device 77. However, it may be modified such that the port 91*c* is in communication with only one of the heatsink 71 and the mist catching device 77, or is in communication with neither of them 71, 77 but with the external space of the pressure control chamber 91. Further, it may be modified such that the air tube 75 is not in communication with the void 71*a* of the heatsink 71, but the end of the air tube 75 on the side of the heatsink 71 is disposed in a vicinity of a surface of the heatsink 71.

In the first to third embodiments, a single suction pump 81 can implement both of the nozzle maintenance processing and the air-chamber suction processing. However, a suction pump may be provided for each of the nozzle maintenance processing and the air-chamber suction processing.

The remaining-amount determination processing in the first to sixth embodiments may be modified such that in the remaining-amount determination processing, merely it is determined whether at least one of the main tanks 5*a*-5*d* is depleted, on the basis of only the result of the detection by the pressure detecting device 60, 160.

In the first to third embodiments, the flushing processing may be initiated after the internal pressure of the air chamber 51 has become negative, which fact is determined based on the result of the detection by the pressure detecting device 60.

In the above-described embodiments, a single gas-permeable film 53 is attached to cover all the communication holes 41*a*-44*a*. However, two or more gas-permeable films may be attached. For instance, it may be arranged such that four gas-permeable films are attached to cover the respective communication holes 41*a*-44*a*.

In the above-described embodiments, the sub tank 31 has the tank mainbody 31*b* and the lid member 31*c*. However, the tank mainbody 31*b* and the lid member 31*c* may be integrally formed.

The inkjet printers of the above-described embodiments are the type in which the head mainbody 30 and the sub tank 31 move with the carriage 9. However, the inkjet printers may be the type where an inkjet head is fixed in position. Further, the invention is applicable to apparatuses other than an inkjet printer, that is, apparatuses ejecting various kinds of liquids that are not ink. For instance, the invention is applicable to an apparatus for applying a coloring liquid used in production of a color filter of a liquid crystal display device. As a method of giving ejection energy for the inks in the head mainbody 30, a thermal method may be employed.

Although there have been described several embodiments of the invention, it is to be understood that the invention is not limited to the details of the embodiments, but may be otherwise embodied with various modifications and improvements that may occur to those skilled in the art, without departing from the scope and spirit of the invention defined in the appended claims.

What is claimed is:

1. A liquid-droplet ejecting apparatus comprising:

a liquid ejecting head having an ejection opening from which a droplet of a liquid is ejected;

a first tank in which a liquid storing chamber and a gas chamber are formed, the liquid storing chamber storing the liquid to be supplied to the liquid ejecting head, and the gas chamber storing a gas;

a second tank which stores the liquid to be supplied to the liquid storing chamber of the first tank;

a gas-permeable film which closes a communication portion at which the gas chamber and the liquid storing chamber communicate with each other and separates the gas chamber and the liquid storing chamber from each other, the gas-permeable film allowing the gas to pass therethrough but not allowing the liquid to pass therethrough;

a suction passage in communication with the gas chamber;

a sucking device which sucks the gas from the gas chamber through the suction passage; and a pressure control device disposed in the suction passage, the pressure control device communicating an internal space of the suction passage with an external space of the suction passage when an internal pressure of the suction passage decreases below a threshold lower than the atmospheric pressure due to the sucking of the gas by the sucking device, in order to inhibit the internal pressure of the suction passage from excessively decreasing.

2. The liquid-droplet ejecting apparatus according to claim 1, wherein the pressure control device includes:

a pressure control chamber having:

a first port in communication with the gas chamber via a part of the suction passage on the side of the gas chamber;

a second port in communication with the sucking device via another part of the suction passage on the side of the sucking device; and a third port in communication with the external space of the suction passage;

a valve element which is disposed in the pressure control chamber and movable between a closing position to close the third port and an opening position to open the third port; and an elastic member which biases the valve element with a biasing force in a direction to move the valve element from the opening position toward the closing position, the biasing force being set such that when an internal pressure of the pressure control chamber is equal to or higher than the threshold, the valve element is held at the closing position, and when the internal pressure of the pressure control chamber is below the threshold, the valve element is allowed to move from the closing position to the opening position due to a pressure difference between the opposite sides of the valve element.

3. The liquid-droplet ejecting apparatus according to claim 2, further comprising:

a mist catching device having a mist suction opening at which is caught a mist of the liquid that occurs in a space outside and around the liquid ejecting head due to the ejection of the droplet of the liquid from the ejection opening; and a gas passage having two opposite ends, one of which is in communication with the third port, and the other of which is in communication with the space outside and around the liquid ejecting head via the mist catching device.

4. The liquid-droplet ejecting apparatus according to claim 3, wherein the mist catching device includes a filter covering the mist suction opening.

5. The liquid-droplet ejecting apparatus according to claim 2, wherein the liquid ejecting head further has:

an ejection passage in communication with the ejection opening; and an ejection-energy giving device which gives ejection energy to the liquid in the ejection passage in order to eject the droplet of the liquid from the ejection opening, and wherein the liquid-droplet ejecting apparatus further comprises:

a driver circuit for supplying the ejection-energy giving device with a drive signal for driving the ejection-energy giving device;

a heatsink which receives heat generated by the driver circuit; and a gas passage having two opposite ends, a first one of which is in communication with the third port, and a second one of which is in communication with an external space of the liquid ejecting head and fixed on the heatsink.

6. The liquid-droplet ejecting apparatus according to claim 5, wherein the heatsink has a void formed inside the heatsink, and at least two connecting ports in communication with the void, the second end of the gas passage being connected with one of the at least two connecting ports.

7. The liquid-droplet ejecting apparatus according to claim 6, wherein both the heatsink and the void inside the heatsink extend along the driver circuit.

8. The liquid-droplet ejecting apparatus according to claim 2, wherein the liquid ejecting head further has:

an ejection-energy giving device which gives ejection energy to the liquid in the ejection passage in order to eject the droplet of the liquid from the ejection opening;

a driver circuit for supplying the ejection-energy giving device with a drive signal for driving the ejection-energy giving device;

a heatsink which receives heat generated by the driver circuit, and has a void formed inside the heatsink and at least two connecting ports in communication with the void;

a mist catching device having a mist suction opening at which is caught a mist of the liquid that occurs in a space outside and around the liquid ejecting head due to the ejection of the droplet of the liquid from the ejection opening;

a first gas passage which communicates one of the at least two connecting ports of the heatsink with the third port of the pressure control chamber; and a second gas passage which communicates another one of the at least two connecting ports with the mist catching device, and is in communication with the space outside and around the liquid ejecting head through the mist suction opening of the mist catching device.

9. The liquid-droplet ejecting apparatus according to claim 8, wherein both the heatsink and the void inside the heatsink extend along the driver circuit.

10. The liquid-droplet ejecting apparatus according to claim 8, wherein the mist catching device includes a filter covering the mist suction opening.

11. The liquid-droplet ejecting apparatus according to claim 1, further comprising:

a mist catching device having a mist suction opening at which is caught a mist of the liquid that occurs in a space outside and around the liquid ejecting head due to the ejection of the droplet of the liquid from the ejection opening; and a gas passage having two opposite ends, one of which is in communication with the sucking device, and the other of which is in communication with the space outside and around the liquid ejecting head via the mist catching device.

12. The liquid-droplet ejecting apparatus according to claim 1, wherein the liquid ejecting head further has an ejection passage in communication with the ejection opening and an ejection-energy giving device which gives ejection energy to the liquid in the ejection passage in order to eject the droplet of the liquid from the ejection opening, and wherein the liquid-droplet ejecting apparatus further comprises:

a driver circuit for supplying the ejection-energy giving device with a drive signal for driving the ejection-energy giving device;

a heatsink which receives heat generated by the driver circuit, and has a void formed inside the heatsink and at least two connecting ports in communication with the void; and a gas passage having two opposite ends one of which is connected with one of the at least two connecting ports of the heatsink, and the other of which is connected with the sucking device.

13. The liquid-droplet ejecting apparatus according to claim 1, further comprising a recording controller which implements a recording operation in which the droplet of the liquid is ejected from the ejection opening.

14. The liquid-droplet ejecting apparatus according to claim 1, wherein the liquid ejecting head has a plurality of the ejection openings which are arranged in a straight line.

* * * * *